US007764805B2

(12) United States Patent
Tomita et al.

(10) Patent No.: US 7,764,805 B2
(45) Date of Patent: Jul. 27, 2010

(54) APPARATUS FOR GENERATING SURROUND SIGNAL FROM TWO-CHANNEL STEREO SIGNAL

(75) Inventors: Yuji Tomita, Kobe (JP); Hideki Matsui, Kobe (JP)

(73) Assignee: Fujitsu Ten Limited, Kobe-shi (JP)

( * ) Notice: Subject to any disclaimer, the term of this patent is extended or adjusted under 35 U.S.C. 154(b) by 1342 days.

(21) Appl. No.: 10/858,615

(22) Filed: Jun. 1, 2004

(65) Prior Publication Data

US 2005/0031128 A1 Feb. 10, 2005

(30) Foreign Application Priority Data

Jun. 2, 2003 (JP) ..... 2003-156670
Oct. 14, 2003 (JP) ..... 2003-354061
Oct. 15, 2003 (JP) ..... 2003-355166
Oct. 15, 2003 (JP) ..... 2003-355453

(51) Int. Cl.
*H04R 5/02* (2006.01)

(52) U.S. Cl. ..... 381/307; 381/1

(58) Field of Classification Search ..... 381/18–23, 381/1, 307, 300

See application file for complete search history.

(56) References Cited

U.S. PATENT DOCUMENTS 5,113,446 A * 5/1992 Kennedy ..... 381/10
5,666,424 A * 9/1997 Fosgate et al. ..... 381/18
7,218,740 B1 * 5/2007 Kowaki ..... 381/18
7,295,608 B2 * 11/2007 Reynolds et al. ..... 375/240.01

FOREIGN PATENT DOCUMENTS

JP 5-91600 4/1993
JP 7-40760 5/1995

(Continued)

OTHER PUBLICATIONS

Patent Abstracts of Japan, Publication No. 10-257600; Date of Publication: Sep. 25, 1998; in the name of Yoshiaki Tanaka.

(Continued)

*Primary Examiner*—Vivian Chin
*Assistant Examiner*—Con P Tran
(74) *Attorney, Agent, or Firm*—Christie, Parker & Hale, LLP.

(57) ABSTRACT

To restrict a loss, or a variation in a loudness, of the sound of a rear speaker if the separation of a two-channel stereo signal degrades in a surround device which generates a four-channel surround signal based on a difference component of the two-channel stereo signal. In a surround device which generates the difference signal based on input left and right channel signal, and generates a driving signal of a front speaker arranged in front of the audience and a driving signal of a rear speaker arranged behind the audience based on the left and right input signals and the difference signal, a part of the driving signal of the front speaker or a part of the two-channel signal is mixed to the driving signal of the rear speaker, and therefore, the loss or the variation in the loudness of the sound of the rear speaker can be restricted even if the separation of the two-channel stereo signal degrades.

27 Claims, 20 Drawing Sheets

FOREIGN PATENT DOCUMENTS

| | | |
|---|---|---|
| JP | 7-46880 | 5/1995 |
| JP | 10-257600 | 9/1998 |
| JP | 10-304500 | 11/1998 |
| JP | 10-336797 | 12/1998 |
| JP | 2000-37000 | 2/2000 |
| JP | 3092149 | 7/2000 |
| JP | 3348730 | 9/2002 |
| KR | 2000-0065108 | 11/2000 |
| WO | WO 97/41711 | 11/1997 |

OTHER PUBLICATIONS

Office action dated Dec. 26, 2007, for corresponding Korean Patent Application No. 10-2007-0032842, indicating the relevance of JP 10-257600, and KR 2000-65108 which was cited in an IDS dated Mar. 10, 2006.

Patent Abstracts of Japan for Publication No. 10336797, publication date Dec. 18, 1998, in the name of Meya Masato.

Patent Abstracts of Japan for Publication No. 2000037000, publication date Feb. 2, 2000, in the name of Meya Masato et al.

Patent Abstracts of Japan for Unexamined Publication No. 62094100, publication date Apr. 30, 1887, in the name of Osawa Mitsuo et al corresponding to Publication No. JP7-40760.

Patent Abstracts of Japan for Publication No. 05091600, publication date Apr. 9, 1993, in the name of Maejima Yoshimichi.

Patent Abstracts of Japan for Unexamined Publication No. 5-168099, publication date Jul. 2, 1993, in the name of Inanaga Kiyofumi corresponding to Publication No. JP3348730.

Patent Abstracts of Japan for Unexamined Publication No. 62-193500, publication date Aug. 25, 1987, in the name of Hibino Masahiro corresponding to Publication No. JP7-46880.

Patent Abstracts of Japan for Unexamined Publication No. 4-94300, publication date Mar. 26, 1992, in the name of Hasegawa Mitsuki corresponding to Publication No. 3092149.

* cited by examiner

APPARATUS FOR GENERATING SURROUND SIGNAL FROM TWO-CHANNEL STEREO SIGNAL

CROSS-REFERENCE TO RELATED APPLICATION

This application claims priority from, and incorporates by reference the entire disclosures of, Japanese Patent Applications:

(1 No. 2003-156670, filed on Jun. 2, 2003.

(2) No. 2003-354061, filed on Oct. 14, 2003.

(3) No. 2003-355166, filed on Oct. 15, 2003.

(4) No. 2003-355453, filed on Oct. 15, 2003.

BACKGROUND OF THE INVENTION

1. Field of the Invention

The present invention relates to an apparatus to generate a surround signal. The present invention particularly relates to an apparatus, to generate a surround signal based on a difference component of a two-channel stereo signal, and is for example, a surround circuit, an audio device, a surround device and an acoustic field controller.

2. Description of the Related Art

Conventionally, a two-channel stereo system is known in which two separate left and right speakers, which produce different sounds, are arranged in front of an audience to produce a sound similar to a live sound. A surround device in which right and left speakers are additionally arranged behind an audience to produce a three-dimensional acoustic sound, to thereby enhance the live sound effect, is also known.

In a prior sound device, the sounds for two front speakers and two rear speakers are generated especially for four channels. The sound of each channel is produced by each speaker corresponding to the four channels. However, due to recent development of circuit technique, a surround device in which a four-channel output signal is generated from a two-channel stereo signal using a surround signal processing circuit and the four-channel output signal is reproduced by four speakers arranged in front of and behind the audience has been proposed. For example, see FIG. 4 of Kokai (Japanese Unexamined Patent Publication) No. 5-091600 and FIGS. 1 and 2 of Kokai No. 7-040760.

A two-channel stereo signal (a left channel signal component L and a right channel signal component R) is input into a surround signal processing circuit of the surround device. The surround signal processing circuit processes therein the two-channel stereo signal and generates and outputs four signals consisting of a channel signal component FL produced by a front left speaker, a channel signal component FR produced by a front right speaker, a channel signal component RL produced by a rear left speaker, and a channel signal component RR produced by a rear right speaker.

However, generally, in such a surround signal processing circuit, the four-channel surround signal is generated based on a difference component which is obtained by removing a correlation component of the stereo two-channel signals L and R, for example, (L-R) component. Consequently, if separation of the input two-channel stereo signals L, R varies for some reasons, for example, a change in the electric field intensity when receiving an FM radio wave, or multi-path noise, the (L-R) component is reduced, resulting in reduction of the volume of the surround signal. This causes the volume of the sound produced by the rear speakers to change or no sound is produced by the rear speakers, in the worst case.

SUMMARY OF THE INVENTION

The present invention is aimed to provide an apparatus to generate surround signals from two-channel stereo signals, such as an acoustic field controller, a surround processing device, a surround device or an acoustic equipment wherein the drawbacks, that loudness of the sound produced by rear speakers fluctuates or no sound is produced by the rear speakers, are eliminated even if correct separation of the input two-channel stereo signals L, R fails, for some reason, in a surround circuit to generate a four-channel surround signal based on a difference component (L-R) between two-channel stereo signals L and R.

In an acoustic field control device of the present invention to achieve the above purpose to which a left channel signal, a right channel signal, and a surround signal generated based on a difference signal generated from these input signals are input, provision of made of an acoustic field controller in which an add signal is generated for a surround effect correction based on one or both of said left and right channel signals, or said surround signal and is added to said predetermined surround signal to control the acoustic field.

In a surround processing device of the present invention to achieve the above purpose, in which a surround signal processing device generates a surround signal, based on an input of a left channel signal, an input of a right channel signal and a difference signal generated from these input signals, provision is made of an acoustic field controller in which an add signal for a surround effect correction is generated based on one or both of said left and right channel signals, and said surround signal and is added to a predetermined surround signal to control the acoustic field.

In a surround processing device of the present invention having a surround signal processor in which a surround signal is generated based on an input left channel signal and an input right channel signal and a difference signal generated from these input signals, an add signal is generated based on one or both of said left channel signal and right channel signal, or said surround signal and is added to a predetermined surround signal.

In an acoustic device of the present invention comprising a reproducing device to output a two-channel stereo signal and a signal processor, to generate a surround signal based on a left channel signal and a right channel signal from the reproducing device and a difference signal generated from the right and left channel signals, a signal is generated based on one or both of said left channel signal and right channel signal or said surround signal, and this signal is added to said surround signal as an add signal.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Before the preferred embodiments of the present invention are explained, an example of a prior art surround circuit will be explained with reference to FIG. 1A and FIG. 1B.

The following discussion is addressed to, for example, reproduction of a four-channel three-dimensional sound from two-channel stereo signals L, R, which are regenerated from a radio wave received by an FM tuner.

Figure 1A:
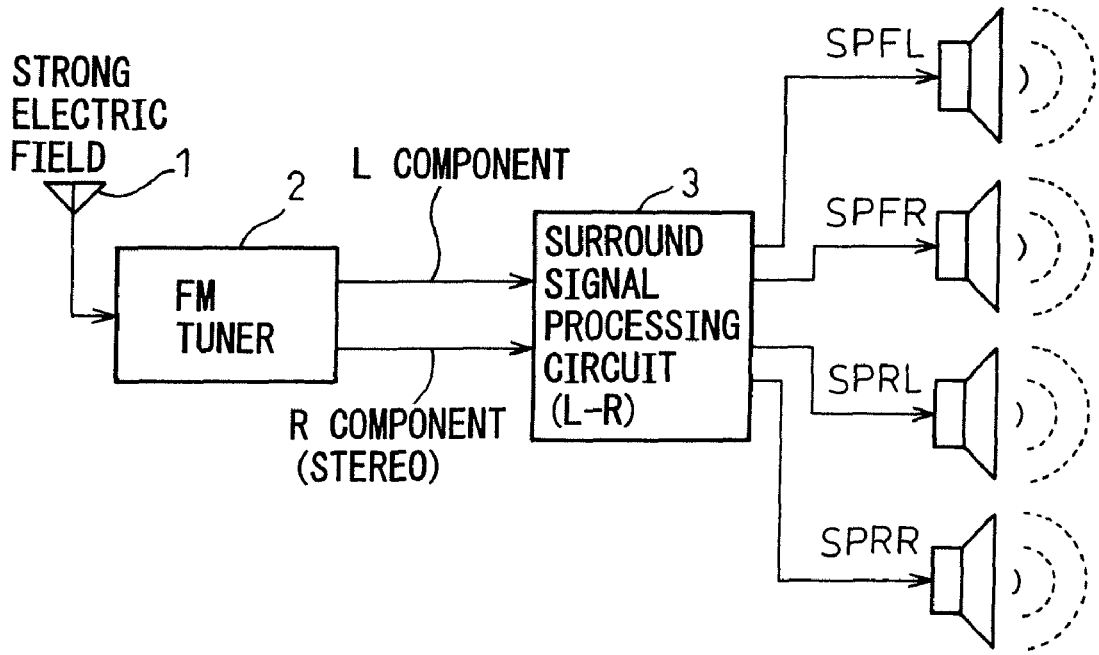
Fig.1A PRIOR ART
FIG. 1A shows an operation of a surround processing circuit when an FM tuner is provided in a strong electric field area.

FIG. 1A shows an operation of a surround signal processing circuit 3 when an antenna 1 and an FM tuner 2 are provided in a strong electric field area. In the strong electric field area, the FM tuner 2 outputs L component and R component that are two-channel stereo signals with high separation. In this case, a (L-R) component is sufficient, and hence, the surround signal processing circuit 3 generates and outputs four signals consisting of a channel signal FL to be produced by a front left speaker SPFL, a channel signal FR to be produced by a front right speaker SPFR, a channel signal RL to be produced by a rear left speaker SPRL, and a channel signal RR to be produced by a rear right speaker SPRR, based on the (L-R) component. As a result, a three-dimensional sound is regenerated from the four speakers, SPFL, SPFR, SPRL, and SPRR.

Figure 1B:
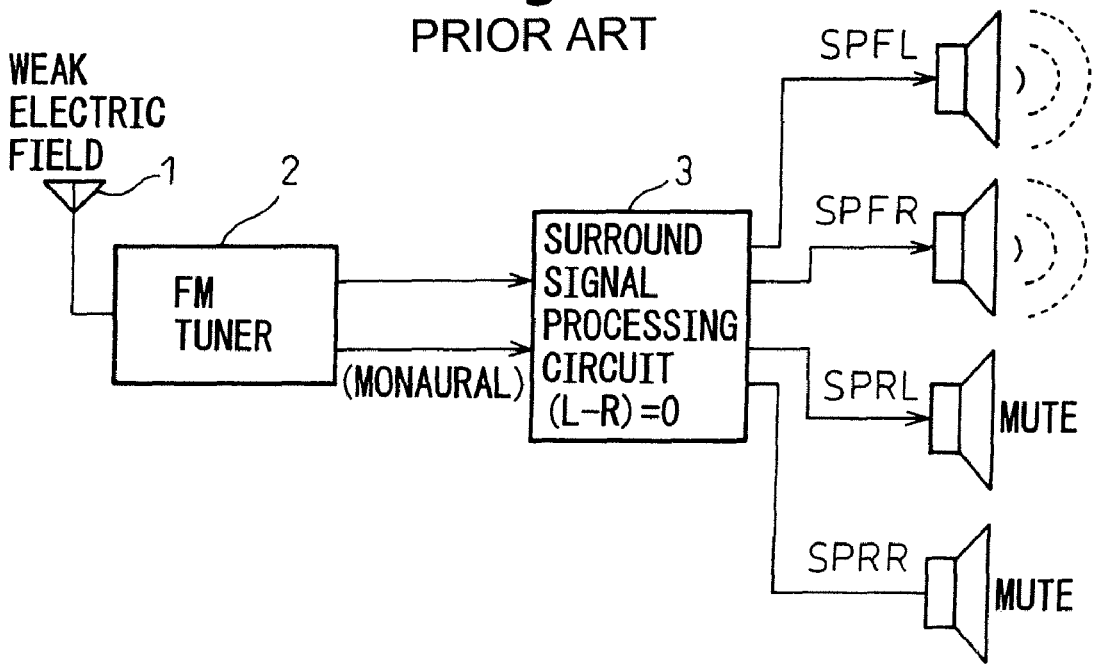
Fig.1B PRIOR ART
FIG. 1B shows a drawback of an operation of a surround processing circuit when an FM tuner is provided in a strong electric field area.

FIG. 1B shows an operation of the surround signal processing circuit 3 when the antenna 1 and the FM tuner 2 are provided in a weak electric field area. In the weak electric field area, the FM tuner 2 outputs an L component and an R component which are two-channel stereo signals with lower separation. In the worst case, the output becomes monaural in which the L component and the R component are identical. In this case, the (L-R) component becomes 0 (zero), and therefore, the surround signal processing circuit 3 can generate the channel signal FL which is produced by the front left speaker SPFL and the channel signal FR which is produced by the front right speaker SPFR, but cannot generate the channel signal RL which is produced by the rear left speaker SPRL and the channel signal RR which is produced by the rear right speaker SPRR. Consequently, the front left speaker SPFL and the front right speaker SPFR can produce a sound, however, the rear left speaker SPRL and the rear right speaker SPRR cannot produce a sound at all.

As described above, the separation of the two-channel stereo signals L, R varies depending on the electric field intensity or the multi-path noise, for example, when the FM tuner is equipped in a vehicle.

Figure 2:
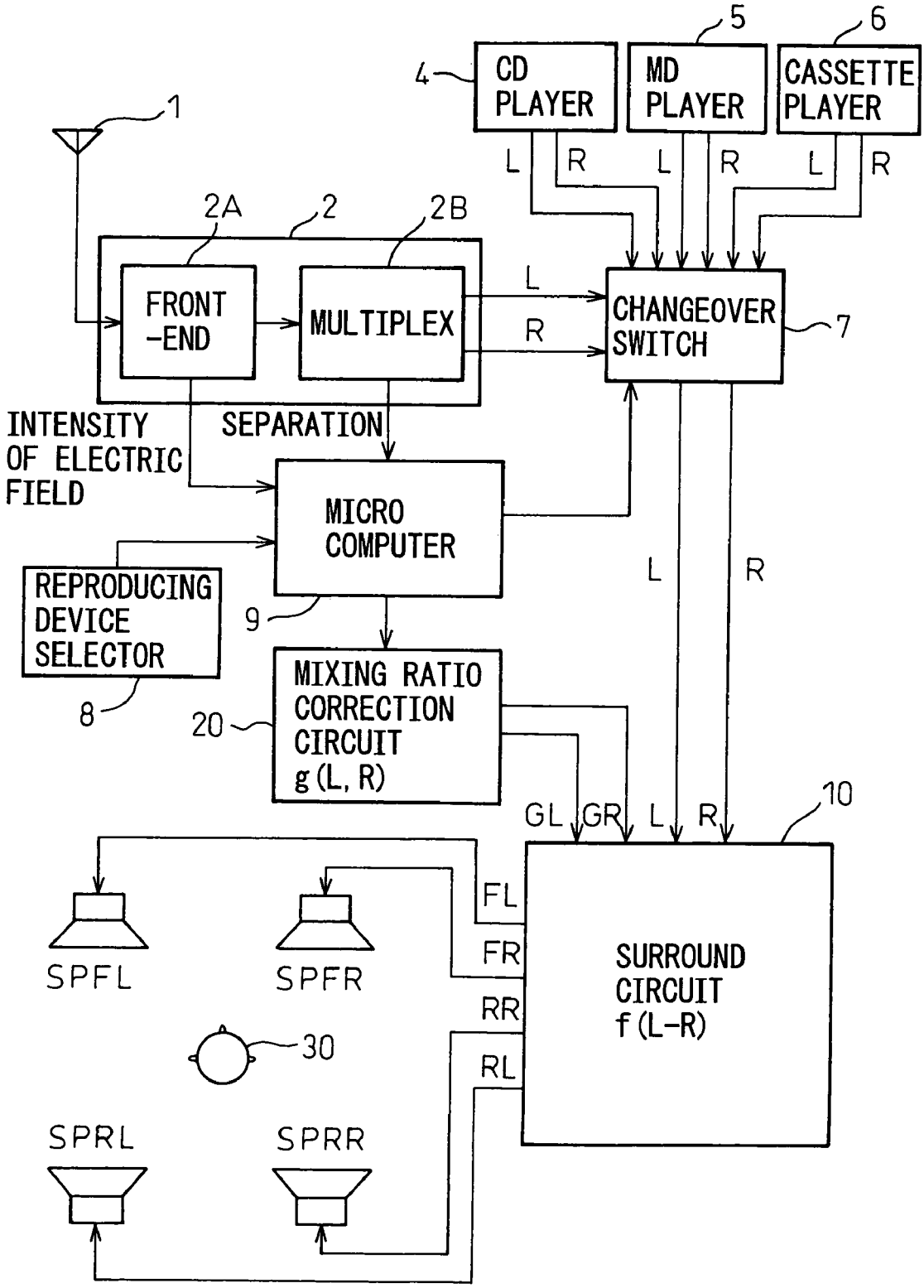
FIG. 2 shows an entire structure of an audio system provided with a surround circuit of the present invention.

Next, an embodiment of the present invention will be explained in detail based on concrete examples. FIG. 2 shows an entire structure of an embodiment of an audio system provided with a surround circuit 10 of the present invention. The audio system of the present invention is a surround system using four speakers, a front left speaker SPFL, a front right speaker SPFR, a rear left speaker SPRL, and a rear right speaker SPRR, which are arranged on the front left, front right, rear left, and rear right sides, of an audience 30, respectively.

The audio system of this embodiment includes the tuner 2 connected to the antenna 1, a CD (compact disk) player 4, an MD (mini disk) player 5, and a cassette player 6, as audio reproducing devices which output the two-channel stereo signals L, R. The signal outputting terminals of these reproducing devices are connected to a changeover switch 7. The tuner 2 can be one of an AM stereo tuner, an FM stereo tuner, and a stereo TV tuner (for receiving a surface wave or a satellite wave). The players can be other than the MD, CD and cassette players 4, 5 and 6 and can include a DVD (Digital Versatile Disk) player, a hard disk player, or a semiconductor memory reproducing device. The changeover switch 7 is used to selectively output one of the two-channel stereo signals L and R output from these reproducing devices to the surround circuit 10. The changeover switch 7 can be included in the surround circuit 10.

Inside the tuner 2, there are provided a front end 2A to output an intermediate frequency produced by a frequency conversion of an radio wave received at the antenna 1, and a multiplex circuit 2B which detects the intermediate frequency to pick up an audio signal in order to generate and output the two-channel stereo signals L, R therefrom. The front end 2A outputs an electric field intensity signal of an electric wave received at the antenna 1, and the electric field intensity signal is input into a micro-computer 9 which generally controls the audio system.

A selector 8 to select one of the reproducing devices (the tuner 2, the CD player 4, the MD player 5, or the cassette player 6) which outputs the two-channel stereo signals L, R is connected to the micro-computer 9. A switching signal corresponding to the producing device selected by the selector 8 for the reproducing devices is transmitted from the micro-computer 9 to the changeover switch 7. As a result, only the output from the reproducing device selected by the selector 8 is output to the surround circuit 10 via the changeover switch 7.

Moreover, the multiplex circuit 2B of the FM tuner 2 outputs a signal which represents a separation of the received stereo signals L, R to the micro-computer 9, and the micro-computer 9 supplies a mixing ratio signal which represents a mixing ratio of other signals to a rear speaker driving signal generated in the surround circuit 10, which will be discussed hereinafter, based on the separation signal, to a mixing ratio correction circuit 20. The mixing ratio correction circuit 20 outputs indication signals GL, GR to indicate the mixing ratio of other signals to the surround circuit 10, based on the instruction from the micro-computer 9. The indication signals GL, GR will be explained in detail in connection with the following embodiments.

The surround circuit 10 generates and outputs signals FL, FR, RL and RR, to be supplied to the front left speaker SPFL, the front right speaker SPFR, the rear left speaker SPRL, and the rear right speaker SPRR, which are arranged on the front left, front right, rear left, and rear right, sides of an audience 30, respectively, based on the two-channel stereo signals L, R supplied from the changeover switch 7.

The internal structure of the surround circuit 10 of the present invention in a four-speaker surround system structured as above will be explained based on first to sixth aspects of the invention, and embodiments therein. The surround circuit 10 of the present invention illustrated in FIG. 2 is provided with a surround signal processing circuit 3 which generates a difference signal (L-R) from a signal L for a left channel and a signal R for a right channel, and also generates driving signals FL, FR of the two front speakers SPFL, SPRR which are arranged in front of the audience 30 and driving signals RL, RR of the two rear speakers SPFL, SPRR which are arranged in rear of the audience, based on the two input signals L, R and the difference signal (L-R). However, the structure of the surround signal processing circuits 3 is known and is not explained herein.

(1.) First Aspect of the Invention

In this aspect of the invention, parts of the driving signals FL, FR of the two front speakers SPFL, SPFR are combined with the driving signals RL, RR of the two rear speakers SPRL, SPRR, respectively, which are generated in the surround signal processing circuit 3 provided in the surround circuit 10 shown in FIG. 2.

FIG. 3 shows a structure of a first embodiment in the first aspect. In this embodiment, an adder 12 is provided on each line of the driving signal RL, RR of the two rear speakers SPRL, SPRR. An amplifier 11R is provided in each line in the front stage of the adders 12. The lines of the driving signals FL, FR for the two front speakers SPFL, SPFR diverge at intermediate portions, and each branch line is connected to the adder 12 via the amplifier 11F. The amplification factors of the amplifier 11F and the amplifier 11R can be either fixed, or varied depending on the separation of the two-channel stereo signals L, R, as described later.

In the first embodiment structured as above, parts of the signals flowing in the lines of the driving signal FL, FR for the two front speakers SPFL, SPFR is mixed in the driving signals RL, RR of the two rear speakers SPRL, SPRR. As a result, even if the driving signals RL, RR of the two rear speakers SPRL, SPRR become 0 (zero), a part of the driving signals FL, FR for the two front speakers SPFL, SPFR is supplied thereto, whereby the drawback that no sound is generated from the two rear speakers SPRL, SPRR can be prevented.

Figure 3A:
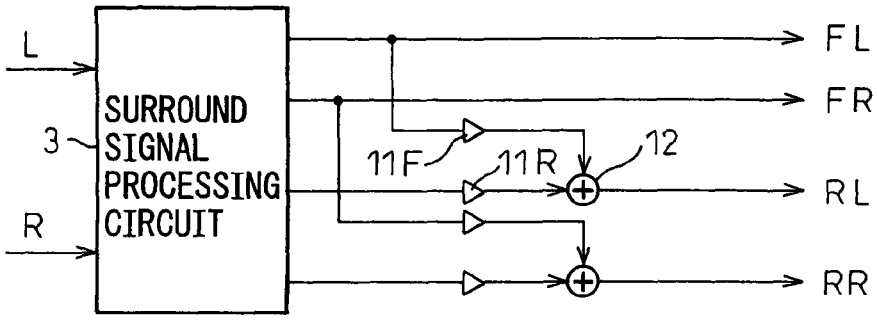
FIG. 3A is a circuit diagram showing a structure of a first embodiment of a first aspect of the invention when a surround circuit of the present invention is applied to a four-speaker system.
Figure 3B:
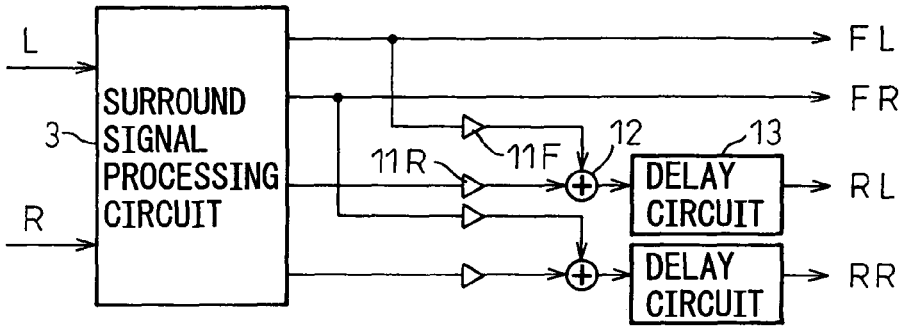
FIG. 3B is a circuit diagram showing a structure of a second embodiment of a first aspect of the present invention.

FIG. 3B shows a structure of a second embodiment in the first aspect of the invention. In this embodiment, a delay circuit 13 is provided after an adder 12 provided in each line of the driving signals RL, RR for the two rear speakers SPRL, SPRR in the first embodiment illustrated in FIG. 3A. The delay times set in the delay circuits 13 can be the same. Due to the delay circuits 13, a time delay occurs in the sounds generated from the two rear speakers SPRL, SPRR, and therefore, the audience can hear the sound as if the sound came from the front of it. Thus, the sound is directional. According to the second embodiment, the problems in the prior art can be solved while providing the sound with directionality from the front.

Figure 3C:
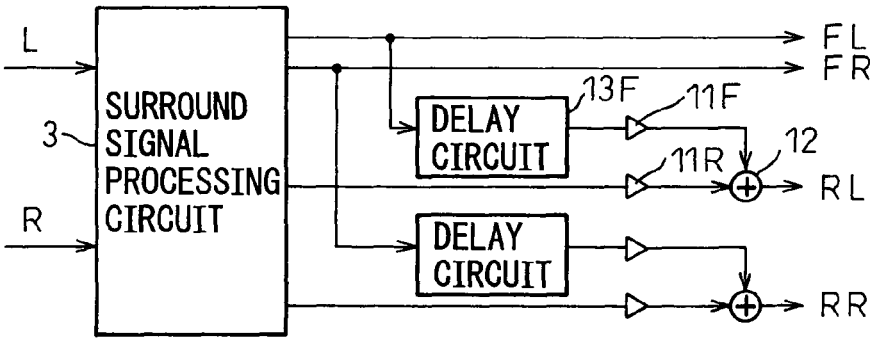
FIG. 3C is a circuit diagram showing a structure of a third embodiment of a first aspect of the present invention.

FIG. 3C shows a structure of a third embodiment in the first aspect of the invention. In this embodiment, a delay circuit 13F is provided between a diverging point of the lines to the two front speakers SPFL, SPFR in the first embodiment illustrated in FIG. 3A and an amplifier 11F. The delay times set in the delay circuits 13F can be the same. Due to the delay circuits 13F, a time delay occurs only in the combined sound for the two front speakers SPFL, SPFR among the sounds produced from the two rear speakers SPRL, SPRR, and therefore, the audience can hear the sound as if the sound came from the front of it. Consequently, the sound is more directional. According to the third embodiment, the directionality of the sound from the front is increased, in addition to the effects of the second embodiment.

Figure 3D:
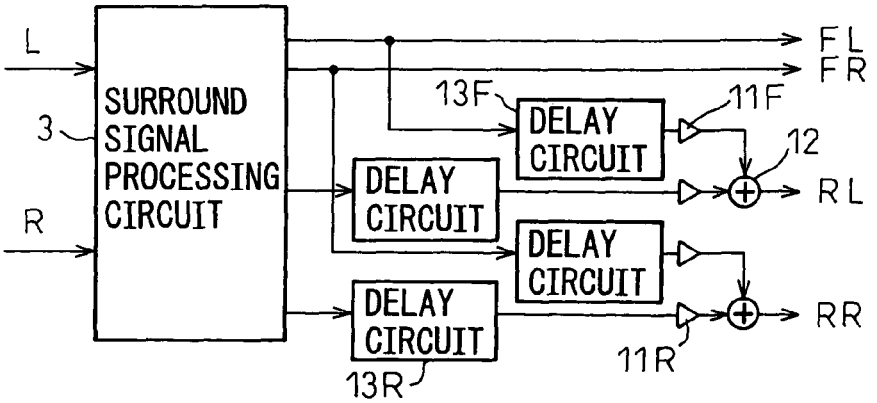
FIG. 3D is a circuit diagram showing a structure of a fourth embodiment of a first aspect of the present invention.

FIG. 3D shows a structure of a fourth embodiment in the first aspect of the invention. In this embodiment, a delay circuit 13R is additionally provided in the front stage of an amplifier 11R provided in each line for the two rear speakers SPRL, SPRR, in the structure of the third embodiment illustrated in FIG. 3C. The delay times set in the two kinds of delay circuits 13F and 13R can be either identical, or different. If the delay times set in the delay circuits 13F and 13R are different, a time difference occurs between the original sound from the two rear speakers SPRL, SPRR and the mixed sound from the two front speakers SPFL, SPFR. As a result, in the fourth embodiment, an acoustic field can be controlled more easily than that in the third embodiment. For example, the sounds from the two rear speakers SPRL, SPRR have wider range and are more directional.

Figure 4A:
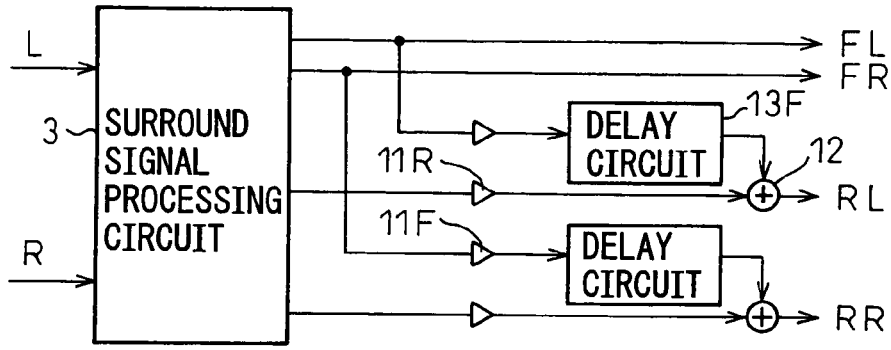
FIG. 4A is a circuit diagram showing a structure of a modified example of the third embodiment in the first aspect of the present invention.
Figure 4B:
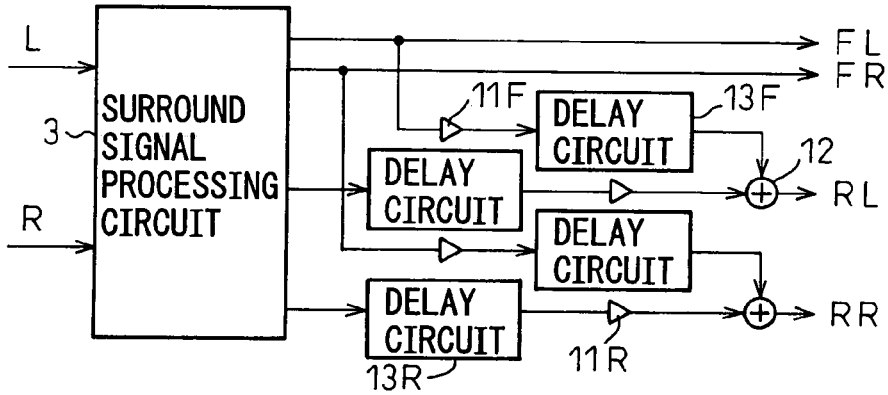
FIG. 4B is a circuit diagram showing a structure of a first modified example of the fourth embodiment in the first aspect of the present invention.
Figure 4C:
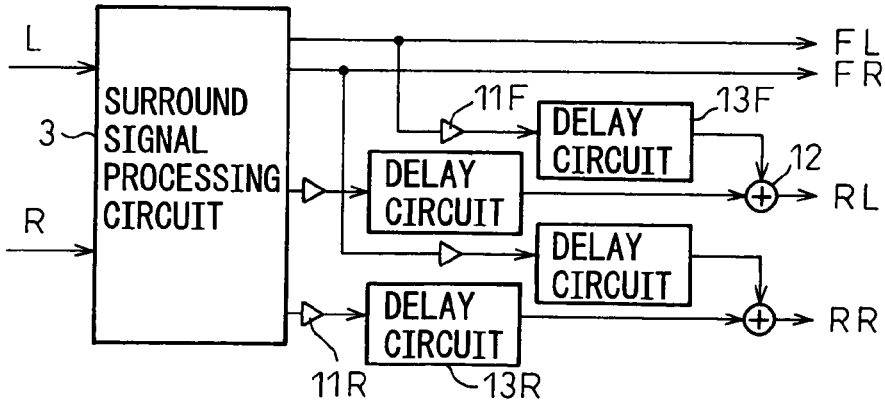
FIG. 4C is a circuit diagram showing a structure of a second modified example of the fourth embodiment in the first aspect of the present invention.

FIG. 4A shows a structure of a modified example of the third embodiment in the first aspect of the invention. In this modified example, the delay circuits 13F, which are provided in the front stage of the amplifiers 11F in the third embodiment, are provided between the amplifiers 11F and the adders 12. The effect of this structure is the same as that of the third embodiment. FIG. 4B shows a structure of a first modified example of the fourth embodiment in the first aspect of the invention. FIG. 4C shows a structure of a second modified example of the fourth embodiment in the first aspect of the invention. In the first modified example, the delay circuits 13F, which are provided in front stage of the amplifiers 11F in the fourth embodiment, are provided between the amplifiers 11F and the adders 12. In the second modified example, the delay circuits 13R, which are provided in front stage of the amplifiers 11R in the fourth embodiment, are provided between the amplifiers 11R and the adders 12. The effect of these structures is the same as that in the fourth embodiment.

(2) Second Aspect of the Invention

In this aspect of the invention, a compression circuit 14 is provided in each of the driving signal lines for the two rear speakers SPRL, SPRR, connected to the surround signal processing circuit 3 in a surround circuit of the first aspect of the invention. The first to fourth embodiments explained hereinafter correspond to the structures of the first to fourth embodiments in the first aspect of the invention.

The compression circuit 14 in the second aspect of the invention is adopted to control the dynamic range of the signal in a compressor circuit, a limiter circuit or the like. According to the operation of the compression circuit 14, a variation in the loudness of the sound loudness from the two rear speakers SPRL, SPRR can be reduced. The effect in which the variation of the loudness of the sound from the two rear speakers SPRL, SPRR can be reduced can be enhanced by mixing a sound from the two front speakers SPFL, SPFR and a sound from the two rear speakers SPRL, SPRR. Consequently, the first to fourth embodiments in the second aspect of the invention will be explained below only in connection with their structures.

Figure 5A:
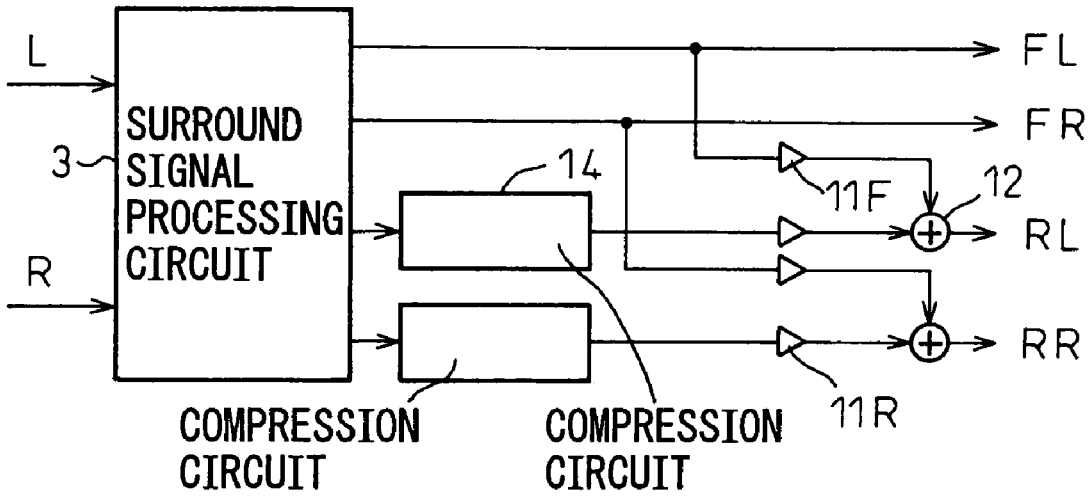
FIG. 5A is a circuit diagram showing a structure of a first embodiment of a second aspect of the invention when a surround circuit of the present invention is applied to a four-speaker system.

FIG. 5A shows a structure of a first embodiment in the second aspect of the invention. The structure of this embodiment corresponds to that in the first embodiment in the first aspect of the invention. The structure of this embodiment differs from that of the first embodiment in the first aspect of the invention only in the point that the compression circuits 14 are provided in the front stage of the amplifiers 11R provided in the lines of the driving signal RL, RR for the two rear speakers SPRL, SPRR.

Figure 5B:
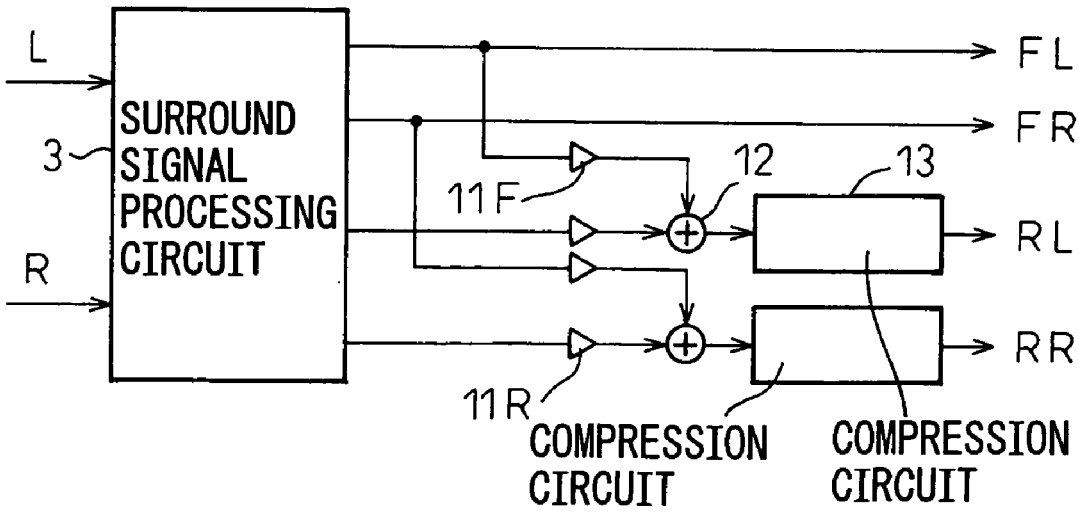
FIG. 5B is a circuit diagram showing a structure of a modified example of a first embodiment of a second aspect of the present invention.

FIG. 5B shows a structure of a modified example of the first embodiment in the second aspect of the invention. This modified example of the first embodiment differs from the first embodiment only in the position of the compression circuits 14. Namely, the compression circuits 14 are provided in the front stage of the amplifiers 11R provided in the lines of the driving signals RL, RR for the two rear speakers SPRL, SPRR in the first embodiment, however, in this modified example, the compression circuits are provided in the rear stage of the adders 12.

Figure 6A:
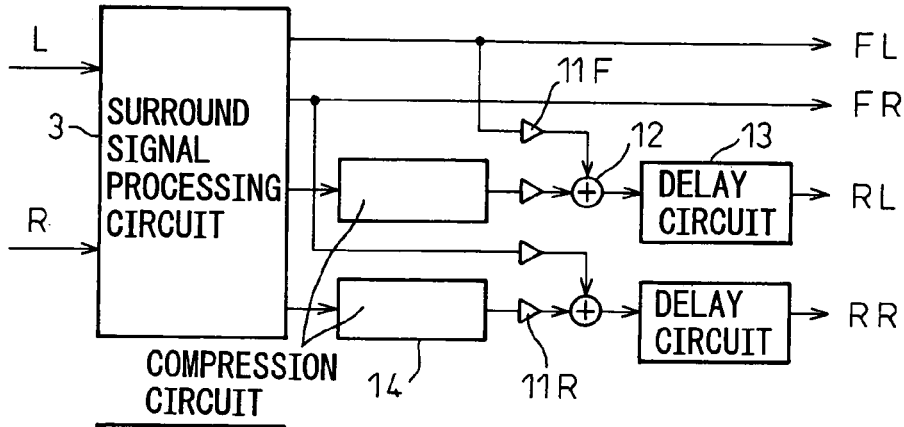
FIG. 6A is a circuit diagram showing a structure of a second embodiment of a second aspect of the present invention.

FIG. 6A shows a structure of a second embodiment in the second aspect of the invention. The structure of this embodiment corresponds to that of the second embodiment in the first aspect of the invention. The structure of this embodiment differs from that of the second embodiment in the first aspect of the invention only in the point that the compression circuits 14 are provided in the front stage of the amplifiers 11R provided in the line of the driving signals RL, RR for the two rear speakers SPRL, SPRR.

Figure 6B:
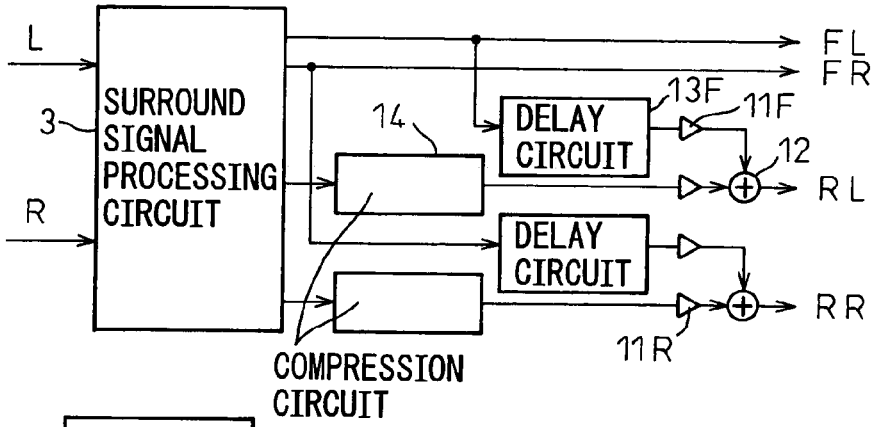
FIG. 6B is a circuit diagram showing a structure of a third embodiment of a second aspect of the present invention.

FIG. 6B shows a structure of a third embodiment in the second aspect of the invention. The structure of this embodiment corresponds to that of the second embodiment in the first aspect of the invention. The structure of this embodiment differs from that of the second embodiment in the first aspect of the invention only in the point that the compression circuits 14 are provided in the front stage of the amplifier 11R provided in each line of the driving signal RL, RR for the two rear speakers SPRL, SPRR.

Figure 6C:
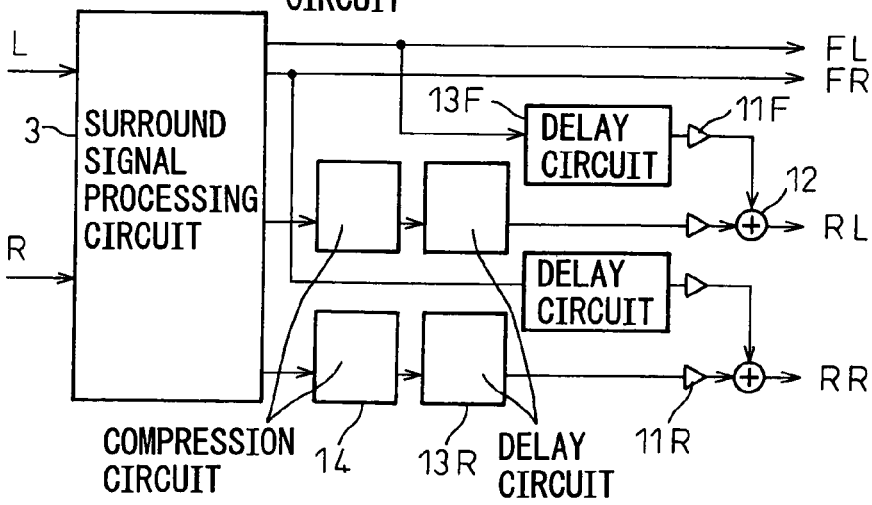
FIG. 6C is a circuit diagram showing a structure of a fourth embodiment of a second aspect of the present invention.

FIG. 6C shows a structure of a fourth embodiment in the second aspect of the invention. The structure of this embodiment corresponds to that of the fourth embodiment in the first aspect of the invention. The structure of this embodiment differs from that of the fourth embodiment in the first aspect of the invention only in the point that the compression circuits 14 are respectively provided in the front stage of the delay circuits 13R provided in the lines of the driving signals RL, RR for the two rear speakers SPRL, SPRR. The compression circuits 14 can be provided between the delay circuits 13R and the amplifiers 11R.

Figure 7A:
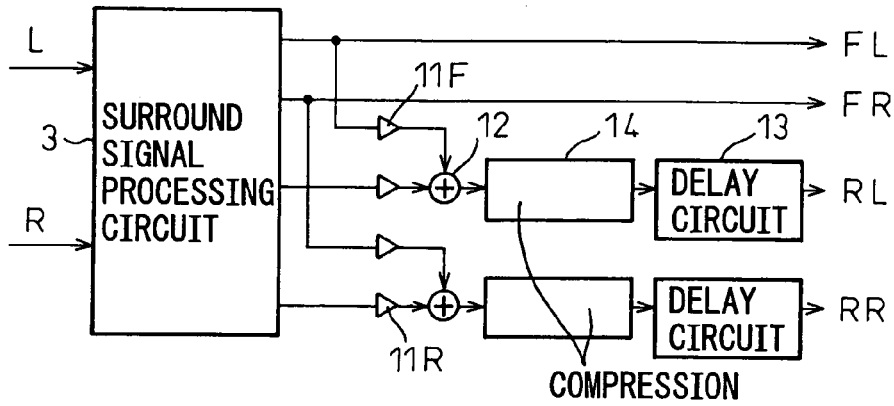
FIG. 7A is a circuit diagram showing a structure of a modified example of a second embodiment of a second aspect of the present invention.
Figure 7B:
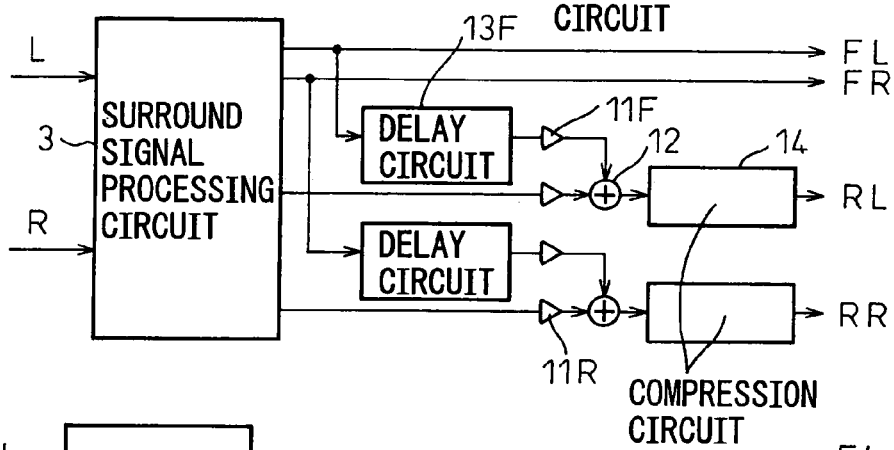
FIG. 7B is a circuit diagram showing a structure of a modified example of a third embodiment of a second aspect of the present invention.
Figure 7C:
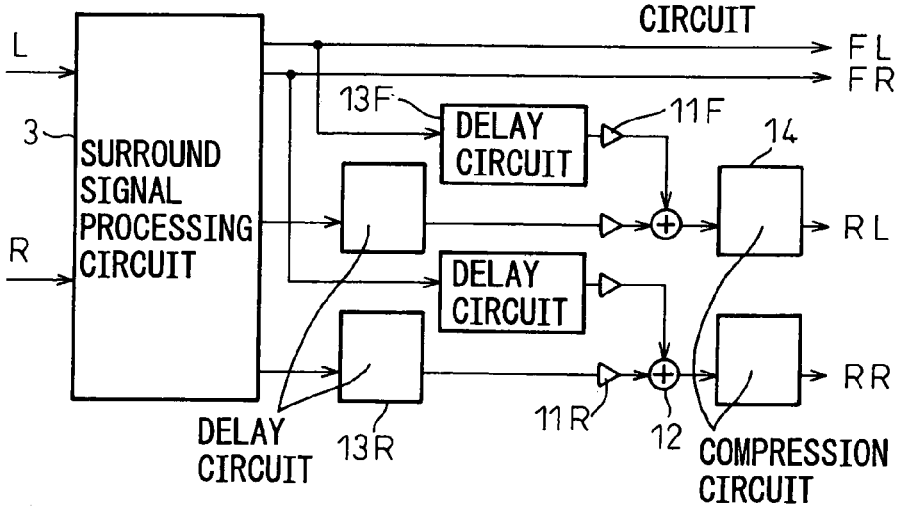
FIG. 7C is a circuit diagram showing a structure of a fourth embodiment of a second aspect of the present invention.

FIG. 7A shows a structure of a modified example of the second embodiment in the second aspect of the invention. In this modified example, the compression circuits 14, which are provided in the front stage of the amplifiers 11R in the second embodiment, are provided between the delay circuits 13 and the adders 12. FIG. 7B shows a modified example of the third embodiment in the second aspect of the invention. In this modified example, the compression circuits 14, which are provided in the front stage of the amplifiers 11R in the third embodiment, are provided in the rear stage of the adders 12. FIG. 7C shows a modified example of the fourth embodiment in the second aspect of the invention. In this modified example, the compression circuits 14, which are provided in the front stage of the delay circuits 13R in the fourth embodiment, are provided in the rear stage of the adders 12.

Various embodiments and modified examples has been explained above. The position of the compression circuits 14 in the driving signal lines for the two rear speakers SPRL, SPRR, connected to the surround signal processing circuit 3 in the second aspect of the invention is not be particularly limited and can be determined appropriately depending on the magnitude of the output signal from the surround signal processing circuit 3.

(3) Third Aspect of the Invention

In this aspect of the invention, a part of the two-channel stereo signals L, R for the surround signal processing circuit 3 is mixed to the driving signals RL, RR generated in the surround signal processing circuit 3 for the two rear speakers SPRL, SPRR respectively.

Figure 8A:
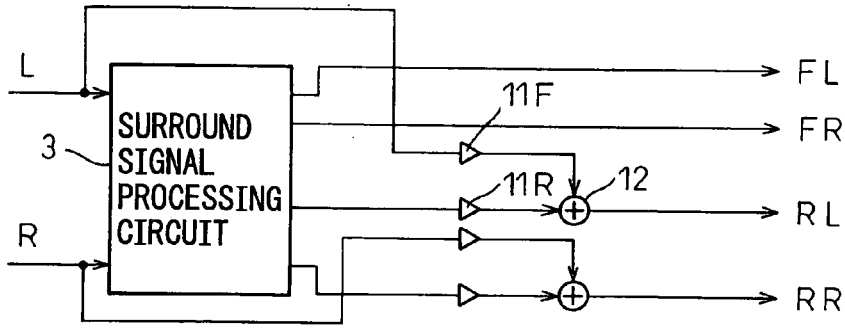
FIG. 8A is a circuit diagram showing a structure of a first embodiment of a third aspect of the invention when a surround circuit of the present invention is applied to a four-speaker system.

FIG. 8A shows a structure of a first embodiment in the third aspect of the invention. In this embodiment, an adder 12 is provided on each line of the driving signals RL, RR for the two rear speakers SPRL, SPRR. The amplifier 11R is provided in the front stage of the adder 12 on each line. The supply lines of the two-channel stereo signals L, R for the surround signal processing circuit 3 diverge at an intermediate portions thereof and each branch line is connected to the adder 12 via the amplifier 11F. The amplification factors of the amplifiers 11F and the amplifiers 11R can be either identical or different depending on the separation of the two-channel stereo signals L, R, as will be described below.

In the first embodiment in the third aspect of the invention structured as above, a part of the signals flowing on the lines of the two-channel stereo signals L, R is mixed to the driving signals RL, RR for the two rear speakers SPRL, SPRR respectively. Consequently, even if the driving signals RL, RR for the two rear speakers SPRL, SPRR become 0 (zero), a part of signals flowing on the lines of the two-channel stereo signals L, R is supplied to the two rear speakers SPRL, SPRR, and therefore, the drawback that no sound is reproduced from the two rear speakers SPRL, SPRR can be eliminated.

Figure 8B:
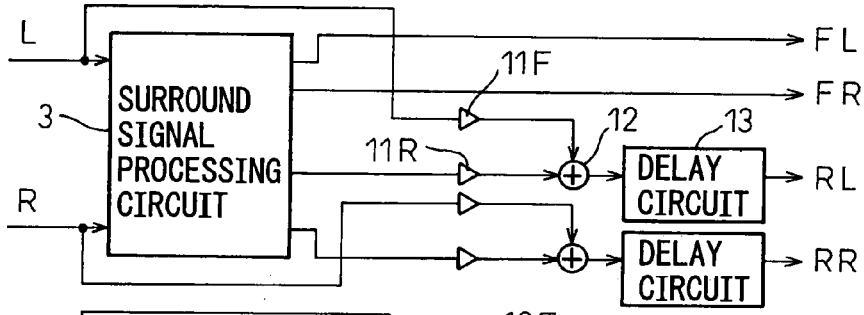
FIG. 8B is a circuit diagram showing a structure of a second embodiment of a third aspect of the present invention.

FIG. 8B shows a structure of a second embodiment in the third aspect of the invention. In this embodiment, a delay circuit 13 is provided in the rear stage of the adder 12 provided in each line of the driving signals RL, RR for the two rear speakers SPRL, SPRR in the first embodiment illustrated in FIG. 8A. The delay times set in the two delay circuits 13 can be the same. Due to the delay circuits 13, a time delay occurs in a sound reproduced from the two rear speakers SPRL, SPRR, and therefore, the audience can hear the sound as if it came from the front of it. Thus the sound is directional. According to the second embodiment, the problems in the prior art can be solved while the directionality of the sound keeps the sense of direction from the front.

Figure 8C:
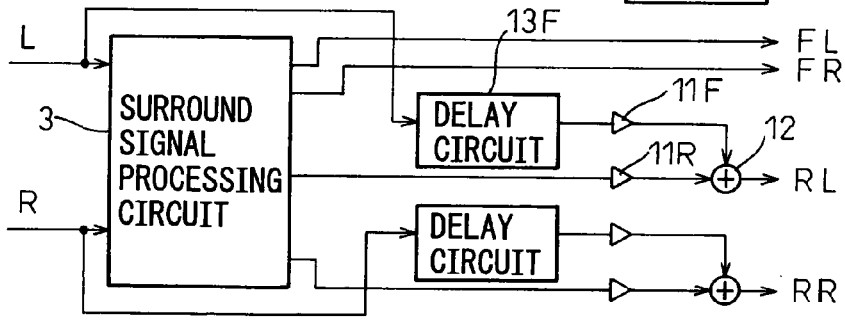
FIG. 8C is a circuit diagram showing a structure of a third embodiment of a third aspect of the present invention.

FIG. 8C shows a third embodiment in the third aspect of the invention. In this embodiment, delay circuits 13F are provided between the diverging points of the lines to the two front speakers SPFL, SPFR in the first embodiment illustrated in FIG. 3A and the amplifiers 11F. The delay times set in the delay circuits 13F can be the same. Due to the delay circuits 13F, a time delay occurs only in a mixed sound for the two front speakers SPFL, SPFR, among the sounds produced from the two rear speakers SPRL, SPRR, and therefore, the audience can hear the sound as if it came from the front of it, and thus the sound is directional. According to the third embodiment, the directionality of the sound from the front can be enhanced, in addition to the effect of the second embodiment.

Figure 8D:
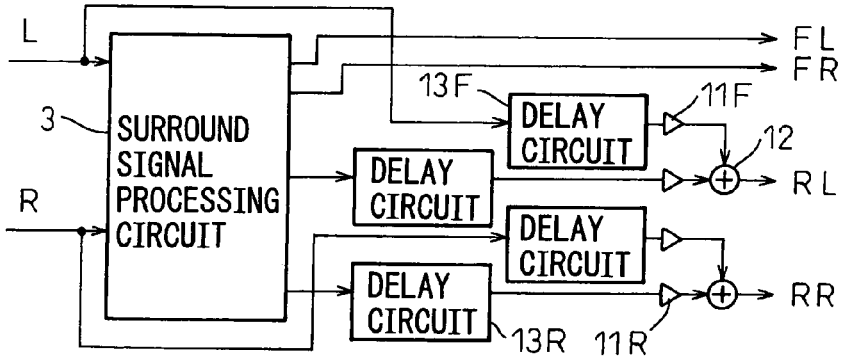
FIG. 8D is a circuit diagram showing a structure of a fourth embodiment of a third aspect of the present invention.

FIG. 8D shows a structure of a fourth embodiment in the third aspect of the invention. In this embodiment, delay circuits 13R are additionally provided in the front stage of an amplifiers 11R provided in the lines of the two rear speakers SPRL, SPRR, in the structure of the third embodiment illustrated in FIG. 3C. The delay times set in the two kinds of delay circuits 13F and 13R can be the same, or can be different. If the delay times set in the delay circuits 13F and 13R are different, a time difference occurs between the original sound from the two rear speakers SPRL, SPRR and the mixed sound from the two front speakers SPFL, SPFR. As a result, in the fourth embodiment, an acoustic field can be controlled more easily than that in the third embodiment. For example, the sound from the two rear speakers SPRL, SPRR have a wider range and is more directional.

Figure 9A:
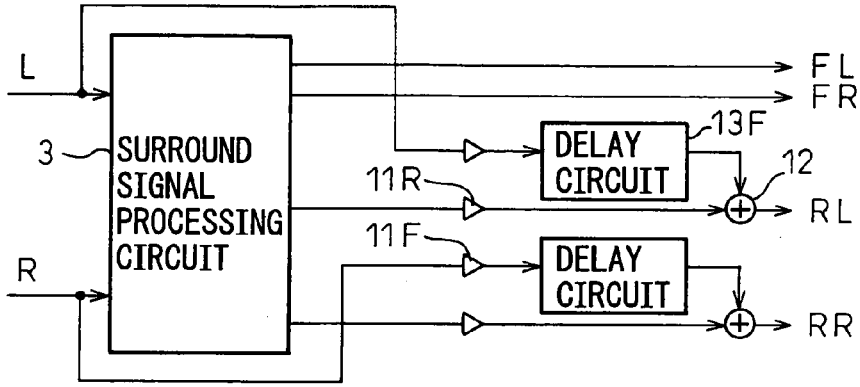
FIG. 9A is a circuit diagram showing a structure of a modified example of a third embodiment of a third aspect of the present invention.
Figure 9B:
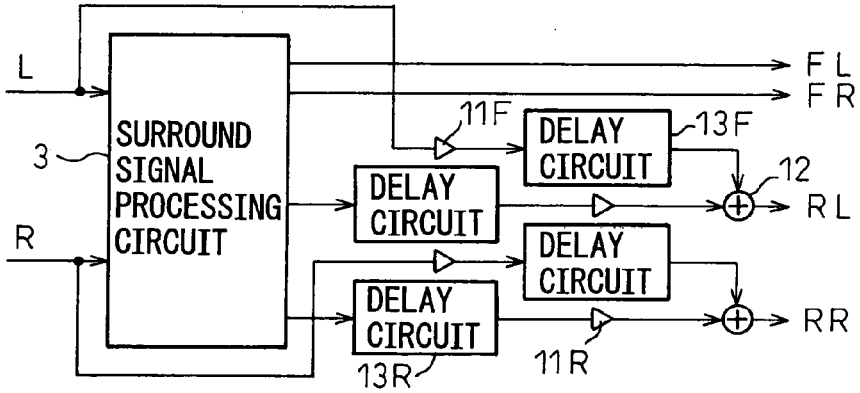
FIG. 9B is a circuit diagram showing a structure of a first modified example of a fourth embodiment of a third aspect of the present invention.
Figure 9C:
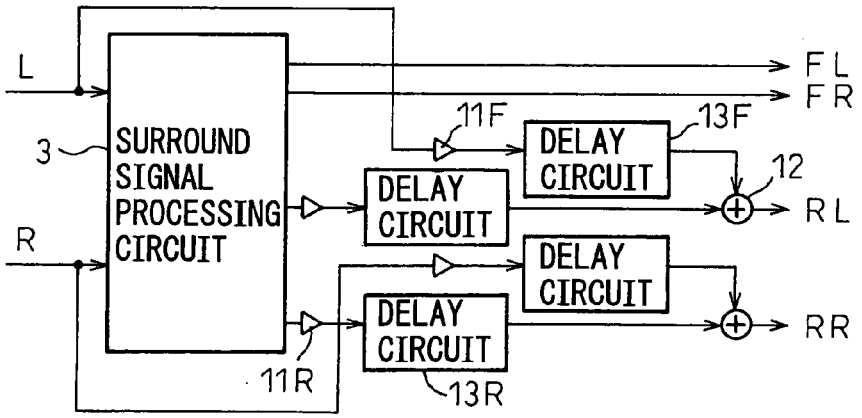
FIG. 9C is a circuit diagram showing a structure of a second modified example of a fourth embodiment of a third aspect of the present invention.

FIG. 9A shows a structure of a modified example of the third embodiment in the third aspect of the invention. In this modified example, the delay circuits 13F, which are provided in the front stage of the amplifiers 11F in the third embodiment, are provided between the amplifiers 11F and the adders 12. The effect of this structure is the same as that of the third embodiment. FIG. 9B shows a structure of a first modified example of the fourth embodiment in the third aspect of the invention. FIG. 9C shows a structure of a second modified example of the fourth embodiment in the third aspect of the invention. In the first modified example, the delay circuit 13F, which is provided in the front stage of the amplifier 11F in the fourth embodiment, is provided between the amplifier 11F and the adder 12. In the second modified example, the delay circuit 13R, which is provided in the front stage of the amplifier 11R in the fourth embodiment, is provided between the amplifier 11R and the adder 12. The effect of these structures is the same as that in the fourth embodiment.

(4) Fourth Aspect of the Invention

In this aspect of the invention, a compression circuits 14 are provided in the driving signal lines of the two rear speakers SPRL, SPRR from the surround signal processing circuits 3 in a surround circuit of the third aspect of the invention. First to fourth embodiments which will be explained hereinafter correspond to the structures of the first to fourth embodiments of the aforementioned third aspect of the invention.

The compression circuits 14 in the fourth aspect of the invention is to control a dynamic range of a signal in a compressor circuit, a limiter circuit or the like, concretely. According to the operation of the compression circuits 14, a variation of the loudness of the sound from the two rear speakers SPRL, SPRR can be reduced. This effect in which the variation of the loudness of the sound from the two rear speakers SPRL, SPRR can be reduced can be more increased by mixing a sound from the two front speakers SPFL, SPFR to the sound from the two rear speakers SPRL, SPRR. Consequently, the first to fourth embodiments in the fourth aspect of the invention will be explained only their structures here.

Figure 10A:
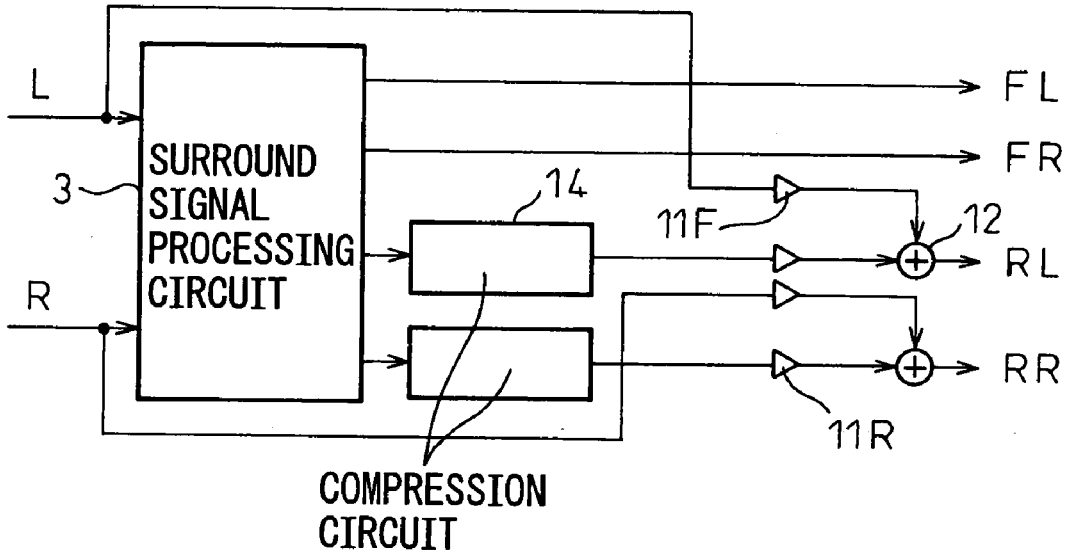
FIG. 10A is a circuit diagram showing a structure of a first embodiment of a fourth aspect of the invention when a surround circuit of the present invention is applied to a four-speaker system.

FIG. 10A shows a structure of a first embodiment in the fourth aspect of the invention. The structure of this embodiment corresponds to that of the first embodiment in the third aspect of the invention. The structure of this embodiment differs from that of the first embodiment in the third aspect of the invention only in the point that the compression circuits 14 are provided in the front stage of the amplifiers 11R provided in the lines of the driving signals RL, RR for the two rear speakers SPRL, SPRR.

Figure 10B:
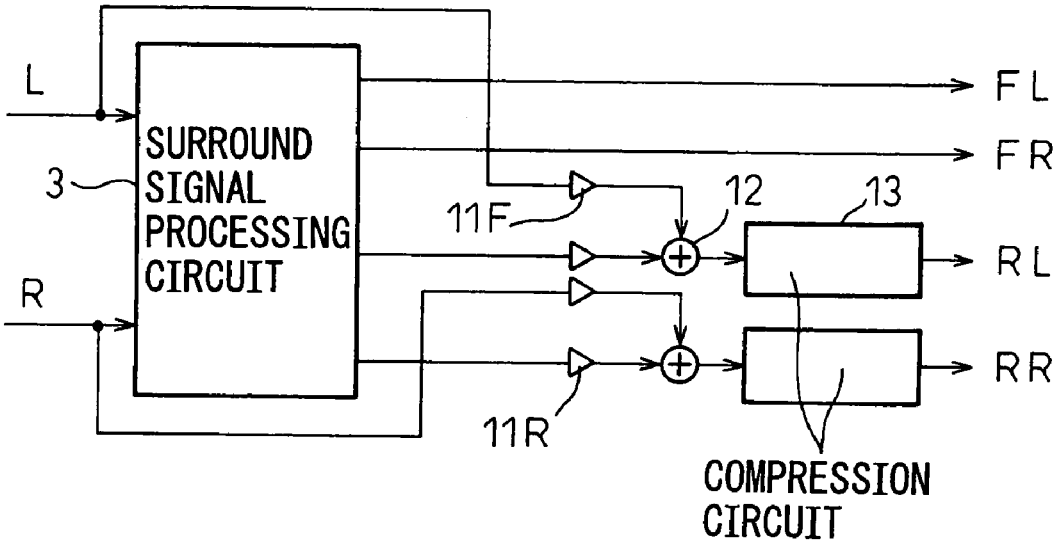
FIG. 10B is a circuit diagram showing a structure of a modified example of a first embodiment of a fourth aspect of the present invention.

FIG. 10B shows a structure of a modified example of the first embodiment in the fourth aspect of the invention. This modified example of the first embodiment differs from the first embodiment only in the position of the compression circuits 14. Namely, the compression circuits 14 are provided in the front stage of the amplifiers 11R provided in lines of the driving signals RL, RR for the two rear speakers SPRL, SPRR in the first embodiment, however, in this modified example, the compression circuits are provided in the rear stages of the adders 12.

Figure 11A:
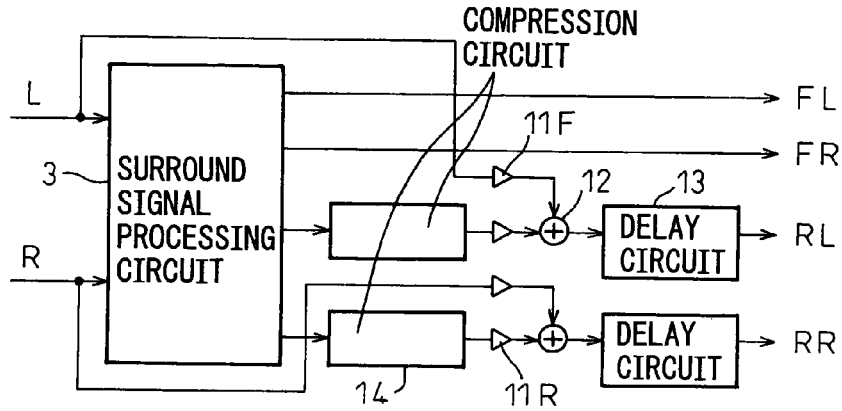
FIG. 11A is a circuit diagram showing a structure of a second embodiment of a fourth aspect of the present invention.

FIG. 11A shows a structure of a second embodiment in the fourth aspect of the invention. The structure of this embodiment corresponds to that of the second embodiment in the third aspect of the invention. The structure of this embodiment differs from that of the second embodiment in the third aspect of the invention only in the point that the compression circuits 14 are provided in the front stage of the amplifiers 11R provided in the lines of the driving signals RL, RR for the two rear speakers SPRL, SPRR.

Figure 11B:
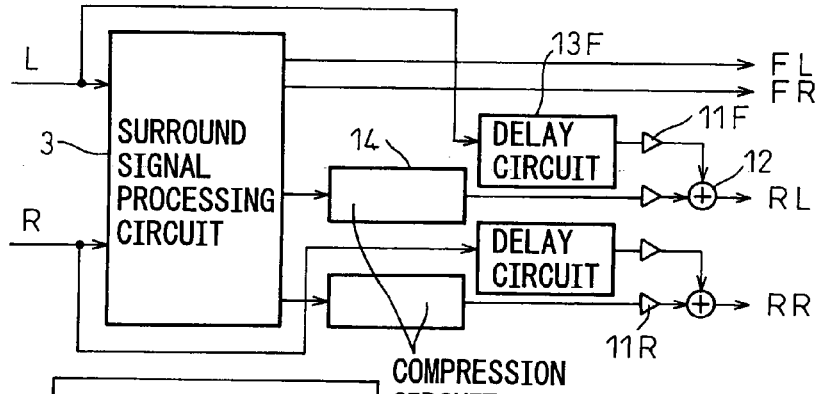
FIG. 11B is a circuit diagram showing a structure of a third embodiment of a fourth aspect of the present invention.

FIG. 11B shows a structure of a third embodiment in the fourth aspect of the invention. The structure of this embodiment corresponds to that of the third embodiment in the third aspect of the invention. The structure of this embodiment differs from that of the third embodiment in the third aspect of the invention only in the point that the compression circuits 14 are provided in the front stage of the amplifiers 11R provided in the lines of the driving signals RL, RR for the two rear speakers SPRL, SPRR.

Figure 11C:
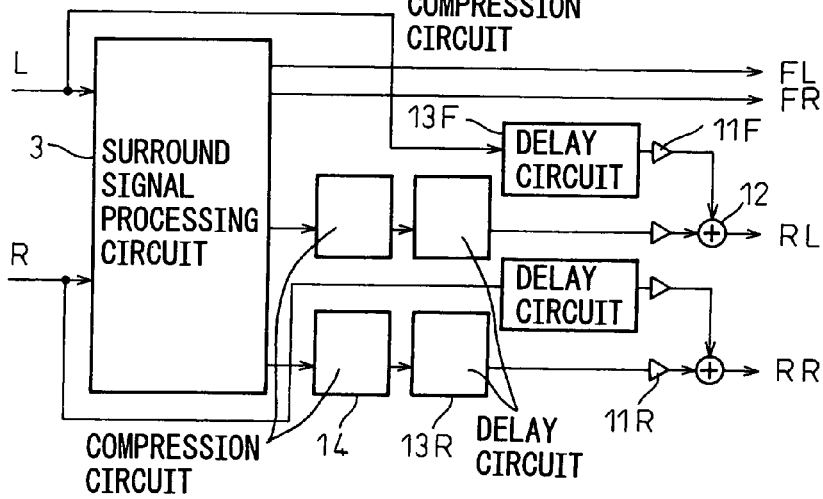
FIG. 11C is a circuit diagram showing a structure of a fourth embodiment of a fourth aspect of the present invention.

FIG. 11C shows a structure of a fourth embodiment in the fourth aspect of the invention. The structure of this embodiment corresponds to that of the fourth embodiment in the first aspect of the invention. The structure of this embodiment differs from that of the fourth embodiment in the first aspect of the invention only in the point that the compression circuits 14 are respectively provided in the front stage of the delay circuits 13R provided in the lines of the driving signals RL, RR for the two rear speakers SPRL, SPRR. The compression circuits 14 can be provided between the delay circuits 13R and the amplifiers 11R.

Figure 12A:
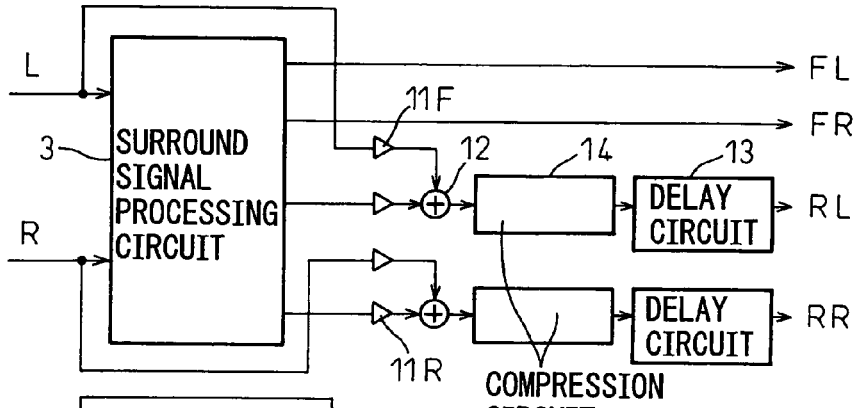
FIG. 12A is a circuit diagram showing a structure of a modified example of a second embodiment of a fourth aspect of the present invention.
Figure 12B:
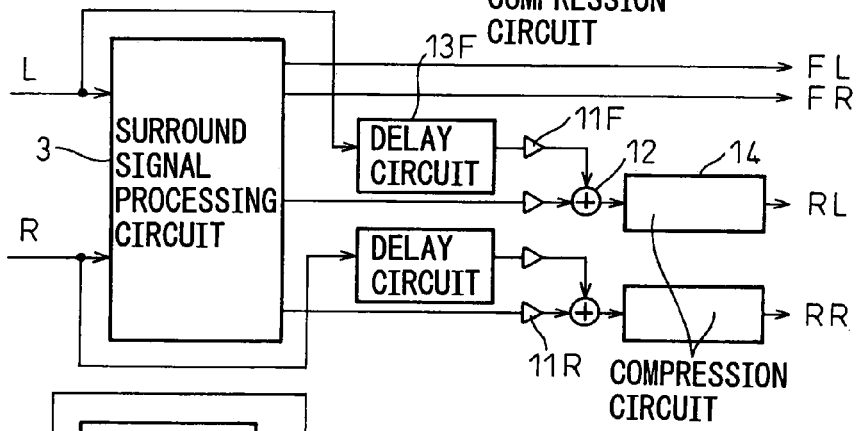
FIG. 12B is a circuit diagram showing a structure of a modified example of a third embodiment of a fourth aspect of the present invention.
Figure 12C:
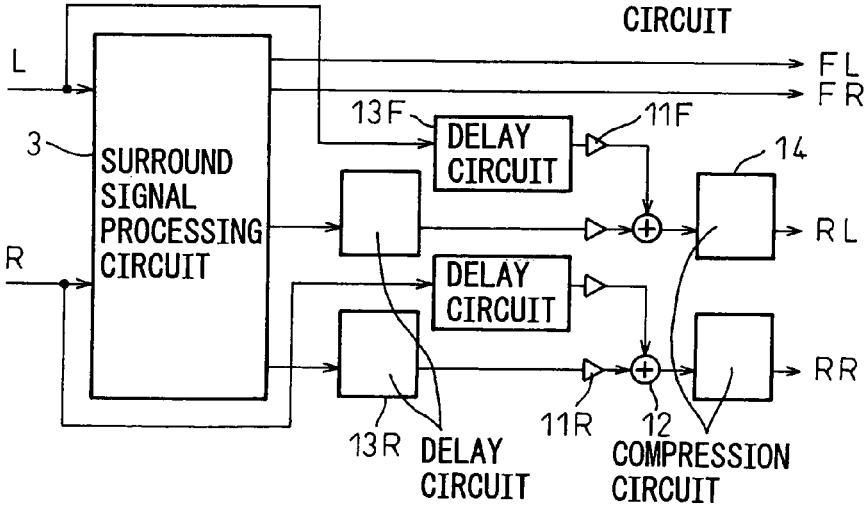
FIG. 12C is a circuit diagram showing a structure of fourth embodiment of a fourth aspect of the present invention.

FIG. 12A shows a structure of a modified example of the second embodiment in the fourth aspect of the invention. In this modified example, the compression circuits 14, which are provided in the front stage of the amplifiers 11R in the second embodiment, are provided between the delay circuits 13 and the adders 12. FIG. 12B shows a modified example of the third embodiment in the fourth aspect of the invention. In this modified example, the compression circuits 14, which are provided in the front stage of the amplifiers 11R in the third embodiment, are provided in the rear stage of the adders 12. FIG. 12C shows a modified example of the fourth embodiment in the fourth aspect of the invention. In this modified example, the compression circuits 14, which are provided in the front stage of the delay circuits 13R in the fourth embodiment, are provided in the rear stage of the adders 12.

Various embodiments and modified examples are explained above. The position of the compression circuits 14 on the driving signal lines of the two rear speakers SPRL, SPRR from the surround signal processing circuit 3 in the fourth aspect of the invention are not particularly limited and can be determined depending on the magnitude of the output signal from the surround signal processing circuit 3.

(5) Fifth Aspect of the Invention

In this aspect of the invention, parts of the driving signals FL, FR of the two front speakers SPFL, SPFR are added in the adders 12 and branched so as to be mixed to the driving signals RL, RR of the two rear speakers SPRL, SPRR from the surround signal processing circuit 3. In other words, the driving signals FL, FR of the two front speakers SPFL, SPFR is added to be monaural, and the part of which is added to the driving signals RL, RR of the two rear speakers SPRL, SPRR.

In the fifth aspect of the invention, because the driving signals FL, FR of the two front speakers SPFL, SPFR is added to be monaural, and the part of which is added to the driving signals RL, RR of the two rear speakers SPRL, SPRR, the separation of a sound from the rear speakers SPRL, SPRR degrades, however, a sound from the behind can be stably produced. In this fifth aspect of the invention, the same embodiments and their modified examples can be made except for adding the driving signals FL, FR of the two front speakers SPFL, SPFR is added to be monaural before branching.

Consequently, regarding the first to fourth embodiments in the fourth aspect of the invention, only their structures will be explained here.

Figure 13A:
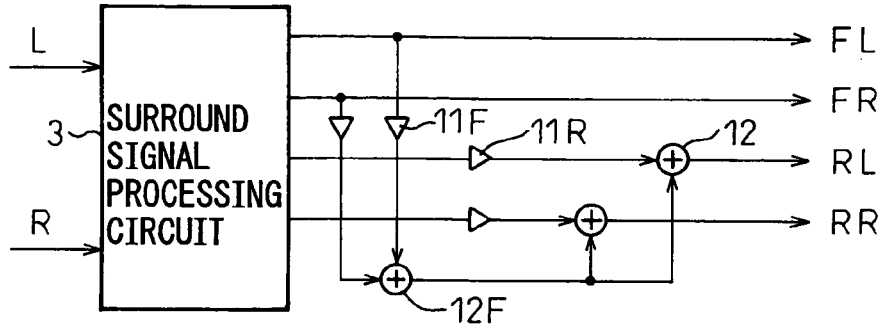
FIG. 13A is a circuit diagram showing a structure of a first embodiment of a fifth aspect of the present invention when a surround circuit of the present invention is applied to a four-speaker system.

FIG. 13A shows a structure of a first embodiment in the fifth aspect of the invention. In this embodiment, the adders 12 are provided on the line of the driving signals RL, RR of the two rear speakers SPRL, SPRR. The amplifiers 11R are provided in the lines in the front stage of the adders 12. The lines of the driving signals FL, FR of two front speakers SPFL, SPFR diverges at an intermediate portion, and each branch lines are connected to the adders 12 via the amplifiers 11F. The output from the adder F can be branched into two and the lines are connected to the adders 12. Only one amplifier 11F must be provided in the rear stage of the adder 12F.

Figure 13B:
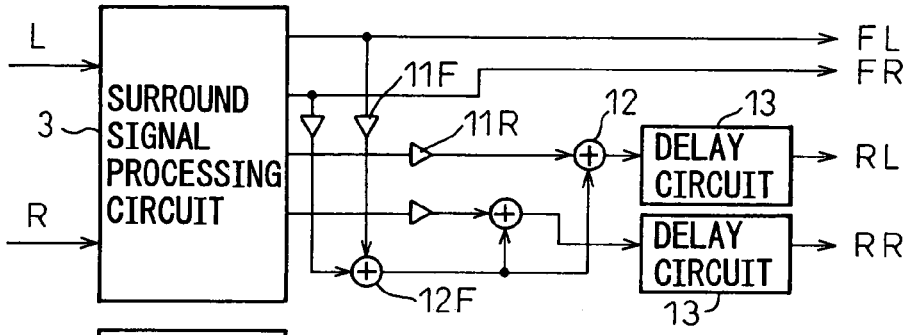
FIG. 13B is a circuit diagram showing a structure of a second embodiment of a fifth aspect of the present invention.

FIG. 13B shows a structure of a second embodiment in the fifth aspect of the invention. In this embodiment, the delay circuits 13 are provided in the rear stage of the adders 12 provided on the lines of the driving signals RL, RR for the two rear speakers SPRL, SPRR described in the first embodiment illustrated in FIG. 13A.

Figure 13C:
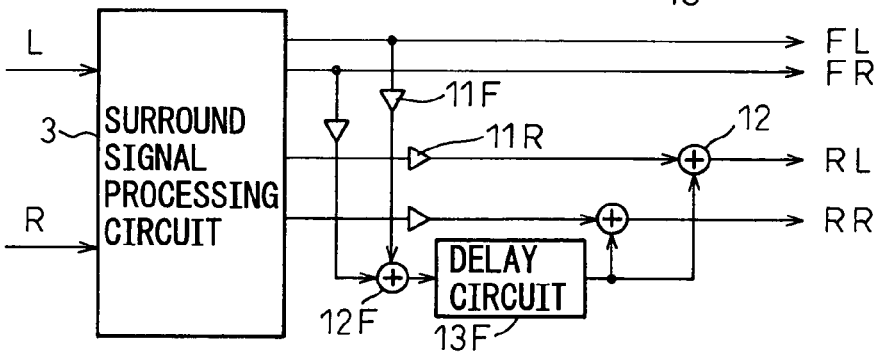
FIG. 13C is a circuit diagram showing a structure of a third embodiment of a fifth aspect of the present invention.

FIG. 13C shows a structure of a third embodiment in the fifth aspect of the invention. In this embodiment, one delay circuits 13 are provided in the rear stage of the adders 12 of the first embodiment illustrated in FIG. 13A.

Figure 13D:
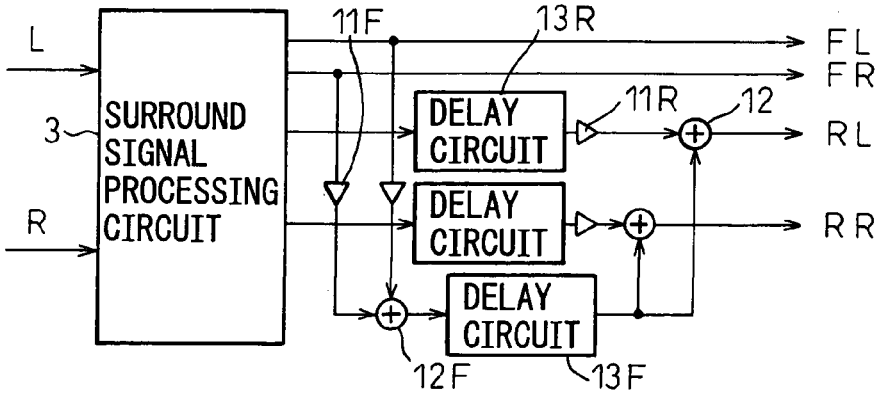
FIG. 13D is a circuit diagram showing a structure of a fourth embodiment of a fifth aspect of the present invention.

FIG. 13D shows a fourth embodiment in the fifth aspect of the invention. In this embodiment, delay circuits 13R are provided in the front stage of the amplifiers 11R on the lines for the two rear speakers SPRL, SPRR, in addition to the structure of the third embodiment illustrated in FIG. 13C.

Moreover, in the fifth aspect of the invention, an embodiment in which the compression circuits 14 are provided on each driving signal line for the two rear speakers SPRL, SPRR from the surround signal processing circuit 3 is possible as well as the second aspect of the invention.

(6) Sixth Aspect of the Invention

In this aspect of the invention, parts of two-channel stereo signals L, R to the surround signal processing circuit 3 are added to the driving signals RL, RR of the two rear speakers SPRL, SPRR generated in the surround signal processing circuit 3 by the adders 12F and are branched and mixed. Namely, the two-channel stereo signals L, R are added and become monaural and a part of which are added to the driving signals RL, RR of the two rear speakers SPRL, SPRR.

In the sixth aspect of the invention, because the two-channel stereo signals L, R are added to be monaural, and the part of which is added to the driving signals RL, RR of the two rear speakers SPRL, SPRR, the separation of the sound from the rear speakers SPRL, SPRR degrades, the sound from the behind can be stably reproduced. In this sixth aspect of the invention, the same embodiments and their modified examples as the third aspect of the invention can be made except for adding the two-channel stereo signals L, R to be monaural before branching.

Consequently, the first to fourth embodiments corresponding to the first to fourth embodiments in the third aspect of the invention and the structure of one modified example will be explained here.

Figure 14A:
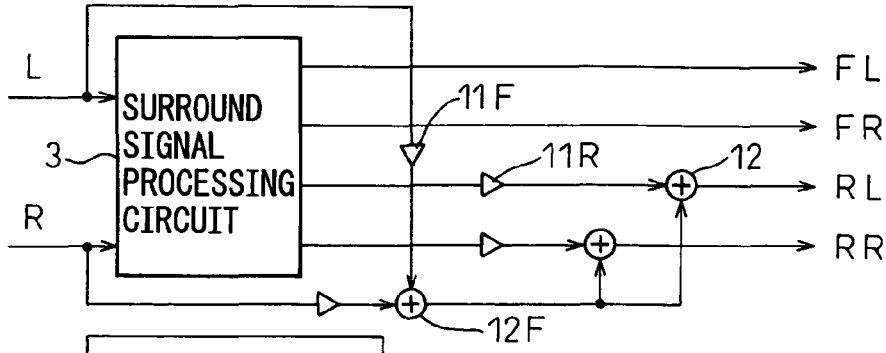
FIG. 14A is a circuit diagram showing a structure of a first embodiment of a sixth aspect of the present invention when a surround circuit of the present invention is applied to a four-speaker system.

FIG. 14A shows a structure of a first embodiment in the sixth aspect of the invention. In this embodiment, the adders 12 are provided on the lines of the driving signals RL, RR of the two rear speakers SPRL, SPRR. The amplifiers 11R are provided in the lines in the front stage of the adders 12. The lines of the two-channel stereo signals L, R are branched at an intermediate portion, and each branched line is connected to the adders 12F via the amplifiers 11F. The output from the adders 12F is branched into two. Only one amplifier 11F must be provided in the rear stage of the adder 12F.

Figure 14B:
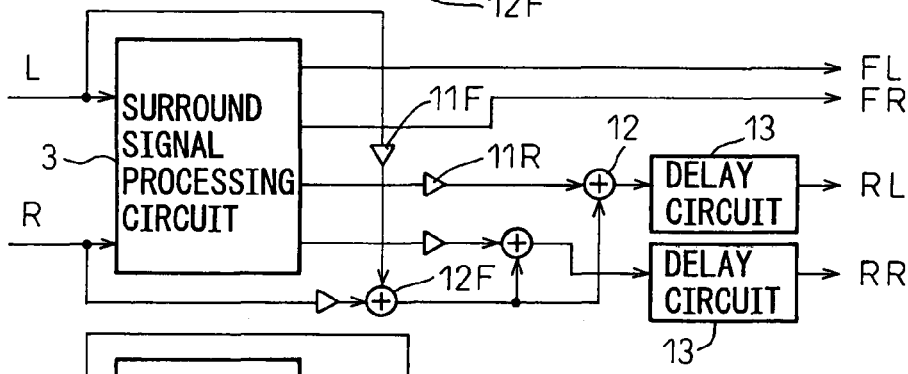
FIG. 14B is a circuit diagram showing a structure of a second embodiment of a sixth aspect of the present invention.

FIG. 14B shows a structure of a second embodiment in the sixth aspect of the invention. In this embodiment, the delay circuits 13 are provided in the rear stage of the adders 12 provided on the line of the driving signals RL, RR for the two rear speakers SPRL, SPRR described in the first embodiment illustrated in FIG. 14A.

Figure 14C:
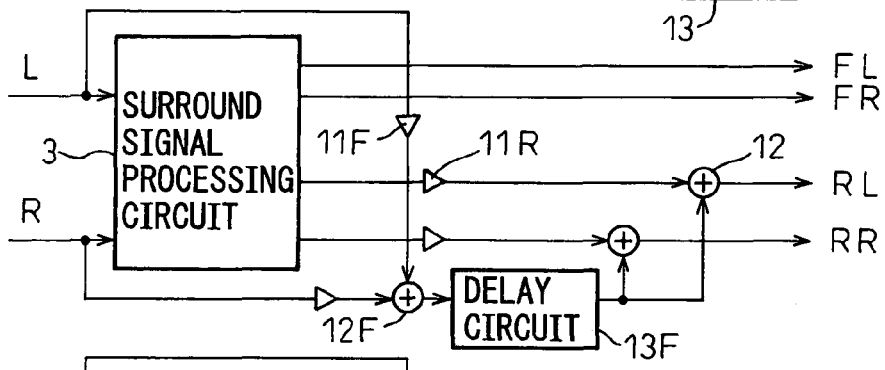
FIG. 14C is a circuit diagram showing a structure of a third embodiment of a sixth aspect of the present invention.

FIG. 14C shows a structure of a third embodiment in the sixth aspect of the invention. In this embodiment, one delay circuit 13 is provided in the rear stage of the adder 12 of the first embodiment illustrated in FIG. 14A.

Figure 14D:
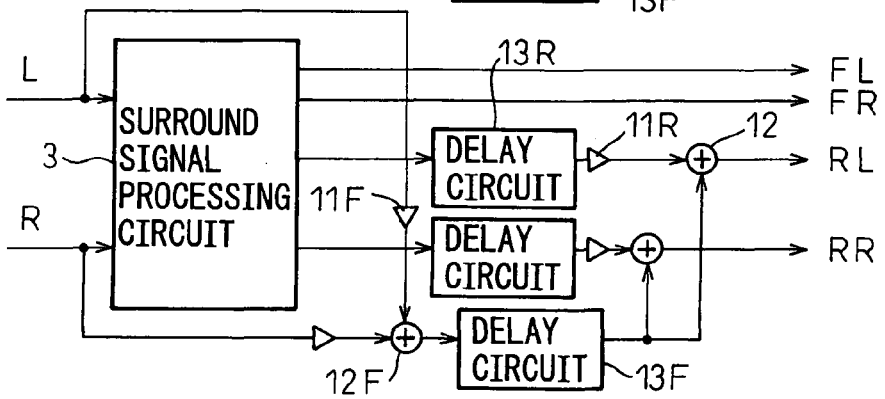
FIG. 14D is a circuit diagram showing a structure of a fourth embodiment of a sixth aspect of the present invention.

FIG. 14D shows a fourth embodiment in the sixth aspect of the invention. In this embodiment, the delay circuits 13R are provided in the front stage of the amplifiers 11R on the lines of the two rear speakers SPRL, SPRR, in addition to the structure of the third embodiment illustrated in FIG. 14C.

Moreover, in the sixth aspect of the invention, an embodiment in which the compression circuits 14 are provided on the driving signal line of the two rear speakers SPRL, SPRR from the surround signal processing circuit 3 is possible as well as the fourth aspect of the invention.

Figure 15A:
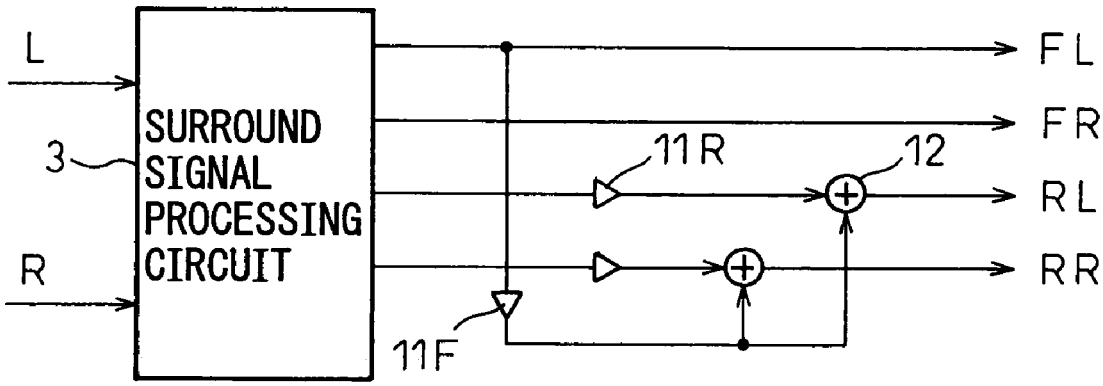
FIG. 15A is a circuit diagram showing a structure of a modified example of a first embodiment of a fifth aspect of the present invention.

FIG. 15A is a circuit diagram showing a structure of one modified example of the first embodiment in the fifth aspect of the invention. In the first embodiment in the fifth aspect of the invention, the driving signals FL, FR of the two front speakers SPFL, SPFR are added to be monaural and parts are added to the driving signals RL, RR of the two rear speakers SPRL, SPRR from the surround signal processing circuit 3. The different point is that a part of one of the driving signals FL, FR of the two front speakers SPFL, SPFR is added in this modified example. In this modified example, a part of the driving signal FL of the front speaker SPFL is added, however, a part of the driving signal FR of the front speaker SPFR can be also added.

Figure 15B:
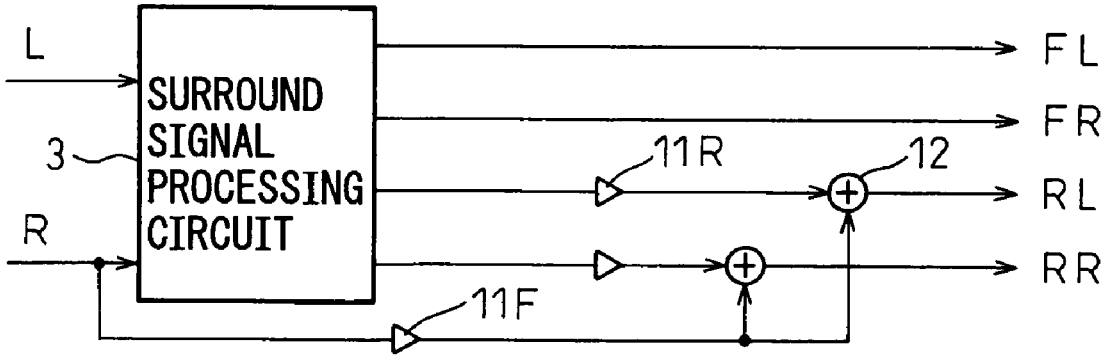
FIG. 15B is a circuit diagram showing a structure of a modified example of a first embodiment of a sixth aspect of the present invention.

FIG. 15B is a circuit diagram showing a structure of one modified example of the first embodiment in the sixth aspect of the invention. In the first embodiment in the sixth aspect of the invention, the two-channel stereo signals L, R are added to be monaural and parts of which are added to the driving signals RL, RR of the two rear speakers SPRL, SPRR. The different point is that a part of one of the two-channel stereo signals L, R is added in this modified example. In this modified example, a part of the two-channel stereo signal L is added, however, a part of the two-channel stereo signal R can be also added.

(7) Gain Control of the Amplifier in the First to Sixth Aspect of the Invention

As described above, in the first to sixth aspects of the invention, the amplifiers 11F and the amplifiers 11R are used, and the amplification factors thereof can be fixed at the predetermined value or can be changeable. A case in which the amplification factors of the amplifiers 11F and the amplifiers 11R will be explained with reference to a circuit of the first embodiment in the first aspect of the invention.

Figure 16A:
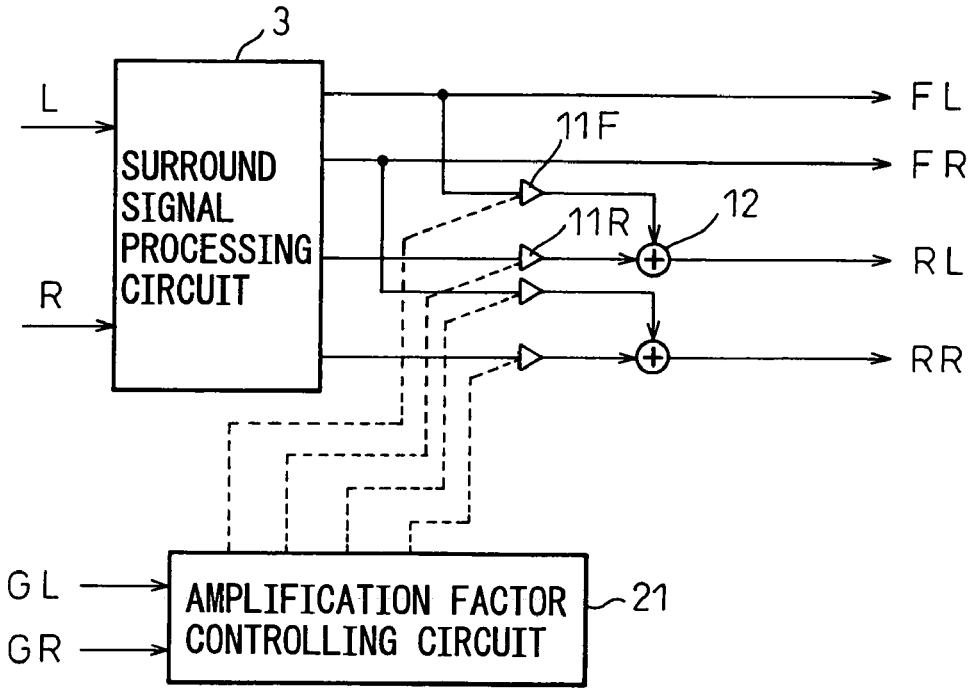
FIG. 16A is a circuit diagram showing a circuit structure which controls a gain of an amplifier provided in a circuit of an embodiment in the present invention.

FIG. 16A shows a status in which the circuit of the first embodiment in the first aspect of the invention is provided with a gain control circuit 21. When the gain control circuit 21 receives mixing ratio instruction signals GL, GR from the mixing ratio correction circuit 20 illustrated in FIG. 2, the gain control circuit 21 determines the gain of the amplifiers 11F and the amplifiers 11R according to the mixing ratio instruction signals GL, GR and controls the gain of the amplifiers 11F and the amplifiers 11R.

Figure 16B:
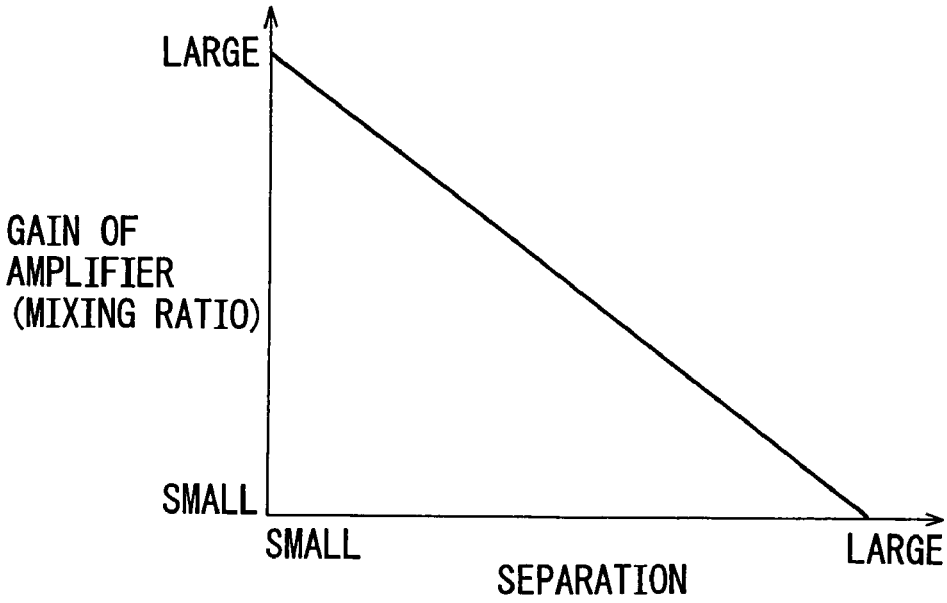
FIG. 16B is a typical illustration of a separation of a two-channel stereo signal and a gain characteristic and each amplifier.

The mixing ratio of the driving signals FL, FR of the two front speakers SPFL, SPFR or the two-channel stereo signals L, R which are mixed to the driving signals RL, RR of the two rear speakers SPRL, SPRR can be low when the separation of the two-channel stereo signals L, R is high. Consequently, the micro-computer 9, for example, stores a data in which characteristics shown in FIG. 16B is mapped as a shareable map or an individual map according to each amplifier. When the separation of the two-channel stereo signals L, R is high, the mixing ratio of the driving signals FL, FR of the two front speakers SPFL, SPFR or the two-channel stereo signals L, R, i.e., the gain of the amplifiers 11F and the amplifiers 11R is controlled to be low.

Moreover, a predetermined threshold value can be set for the separation value of the two-channel stereo signals L, R. If the input separation of the two-channel stereo signals L, R is higher than the threshold value, the mixing ratio of the driving signals FL, FR of the two front speakers SPFL, SPFR or the two-channel stereo signals L, R, i.e., the gain of the amplifier 11F and the amplifier 11R can be controlled to be low.

According to such controls, if the separation of the two-channel stereo signals L, R is high, a surround effect is exhibited. If the separation is low, a drawback in which the rear speakers do not produce sound can be eliminated.

Furthermore, the amount of another signal which is added to the driving signals for the rear speakers can be controlled depending on a kind of input source of the two-channel stereo signals L, R to the surround circuit 10, which can be switched by the changeover switch 7 illustrated in FIG. 2. For example, in a player which reproduces a stereo signal from a recording medium such as a CD, an MD, a cassette, a DVD, a hard disk, or a semiconductor memory, the separation of the stereo signals can not vary, but the separation of the stereo signals to be reproduced can vary according to a reception environment in a tuner which receives electric waves. Therefore, the amount of another signal to be added to the driving signals for the rear speakers can be controlled to be larger in a tuner, and can be controlled to be smaller in a player.

(8) Seventh Aspect of the Invention

In the first to sixth aspect of the invention explained above, a surround circuit of the present invention is applied to a surround system in which four speakers consisting of a front left speaker SPFL, a front right speaker SPFR, a rear left speaker SPRL, and a rear right speaker SPRR, are used which are arranged on the front left, front right, rear left, and rear right sides of the audience 30, respectively.

Figure 17A:
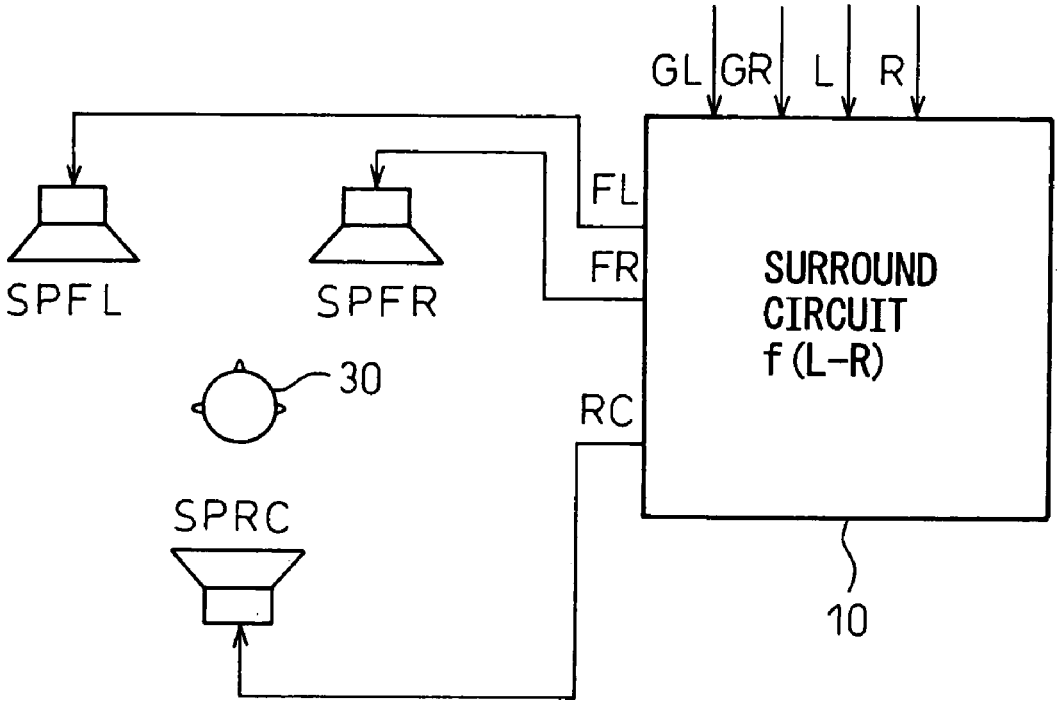
FIG. 17A shows an example of an arrangement of each speaker in a seventh aspect of the invention in which a surround circuit of the present invention is applied to a three-speaker system.

In the seventh aspect of the invention, as shown in FIG. 17A, the surround circuit of the present invention is applied to a surround system using three speakers; a front left speaker SPFL, a front right speaker SPFR which are arranged on front left and front right sides respectively, and a single rear speaker. In the seventh aspect of the invention, parts of the driving signals FL, FR of the two front speakers SPFL, SPFR or parts of the two-channel stereo signals L, R are combined and added, to the driving signal RC of the rear speaker SPRC.

Figure 17B:
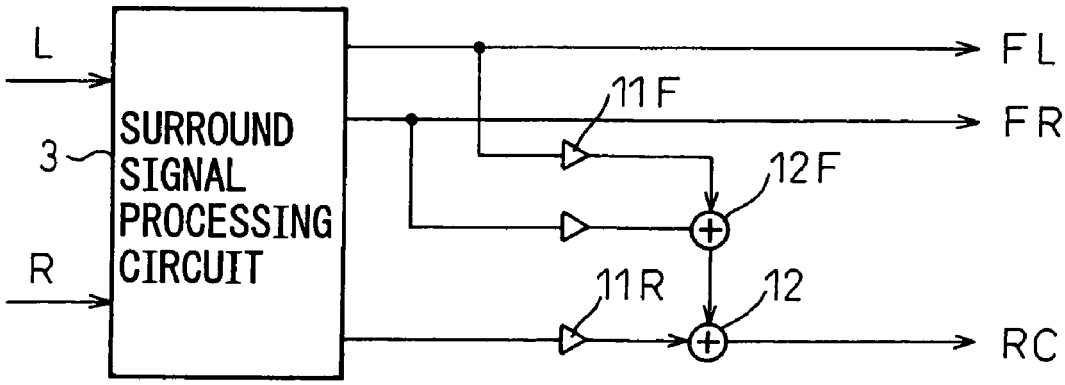
FIG. 17B is a circuit diagram showing a structure of an embodiment in a seventh aspect of the present invention.

FIG. 17B is a circuit diagram showing a structure of one embodiment in the seventh aspect of the invention, which corresponds to the first embodiment in the first aspect of the invention. In this embodiment, the adder 12 is provided on the driving signal RC line for the rear speaker SPRC. The amplifier 11R is also provided on the line in the front stage of the adder 12. The lines of the driving signal FL, FR for the two front speakers SPFL, SPFR are branched at intermediate portions, and each branched line is connected to the adder 12 via the amplifier 11F.

Alternatively, the seventh aspect of the invention can be embodied by the following embodiments:

(A) A delay circuit is provided in the front or rear stage of the adder 12.

(B) A delay circuit is provided in the front or rear stage of the amplifier 12.

(C) Delay circuits are provided in front or rear of stage of the amplifiers 11F and 11R.

(D) A compression circuit is provided on the driving signal line for the rear speaker SPRC.

(E) A part of one of the driving signals FL, FR for the two front speakers SPFL, SPFR, or a part of the two-channel stereo signals L, R, is added to a line for the rear speakers SPRL, SPRR.

(9) Eighth Aspect of the Invention

Figure 18A:
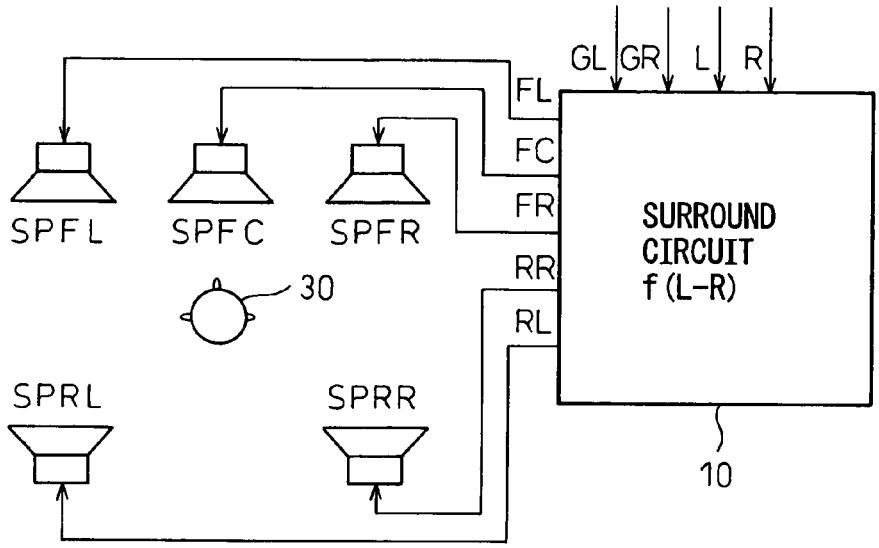
FIG. 18A shows an example of an arrangement of each speaker in an eighth aspect of the invention in which a surround circuit of the present invention is applied to a five-speaker system.

In the eighth aspect of the invention, as shown in FIG. 18A, a surround circuit of the present invention is applied to a surround system in which a front center speaker SPFC arranged on front center of the audience 30, in addition to the four speakers, are used. In the eighth embodiment, there are a first mode and a second mode; in the first mode, a part of the driving signals FL, FR of the two front speakers SPFL, SPFR are added, or a part of the two-channel stereo signals L, R are added to the driving signals RL, RR of the two rear speakers SPRL, SPRR generated in the surround signal circuit 3, and in the second mode, a part of the driving signal FC of the front center speaker SPFC is added.

Figure 18B:
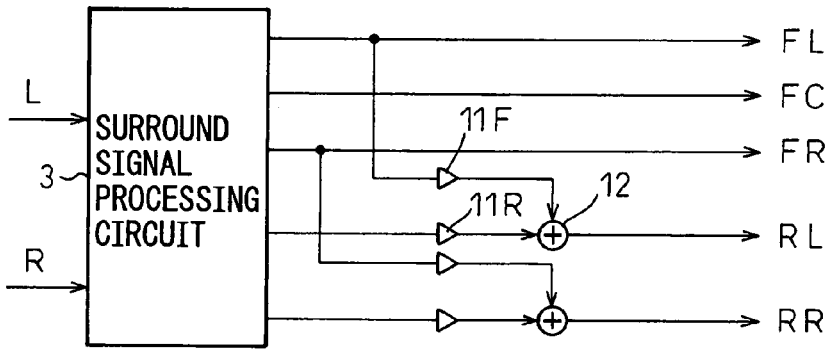
FIG. 18B is a circuit diagram showing a structure of a first embodiment in an eighth aspect of the present invention.
Figure 18C:
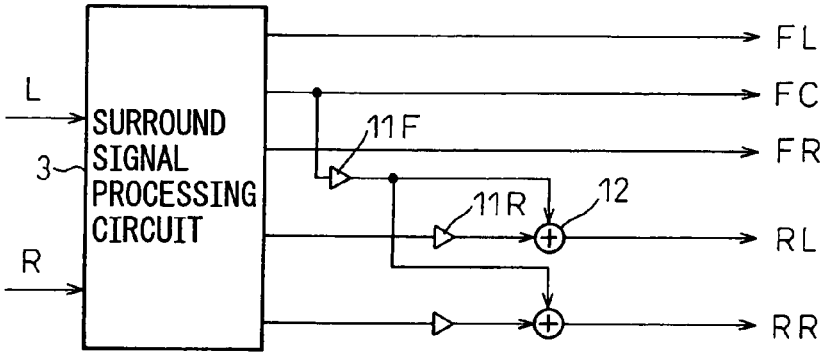
FIG. 18C is a circuit diagram showing a structure of a second embodiment in an eighth aspect of the present invention.

FIG. 18B shows the first embodiment in the first mode in which the driving signal FC of the front center speaker SPFC from the surround signal circuit 3 at the center front is added to a structure of the first embodiment in the first aspect of the invention illustrated in FIG. 3A to which the remaining structure of this embodiment is identical and the explanation is omitted. FIG. 18C shows the second embodiment in the second mode in which a part of the driving signal FC of the front center speaker SPFC is amplified in the amplifiers 11F and is added to the adders 12 which is provided on the lines of the driving signals RL, RR of the two rear speakers SPRL, SPRC.

Alternatively, the eighth aspect of the invention can be embodied by the following embodiments:

(A) A delay circuit is provided in front or rear stage of the adder 12.

(B) A delay circuit is provided in front or rear stage of the amplifier 11F.

(C) Delay circuits are provided in front or rear stage of the amplifiers 11F and 11R.

(D) A compression circuit is provided on the driving signal lines of the rear speakers SPRL, SPRR.

(E) A part of mixture of the driving signals FL, FR of the two front speakers SPFL, SPFR, or a part of mixture of the two-channel stereo signals L, R, is added to the driving signal line for the rear speakers SPRL, SPRR after branched.

(F) A part of one of the driving signal FL, FR of the two front speakers SPFL, SPFR, or a part of the two-channel stereo signals L, R, is added to the lines for the rear speakers SPRL, SPRR.

(10) Ninth Aspect of the Invention

Figure 19A:
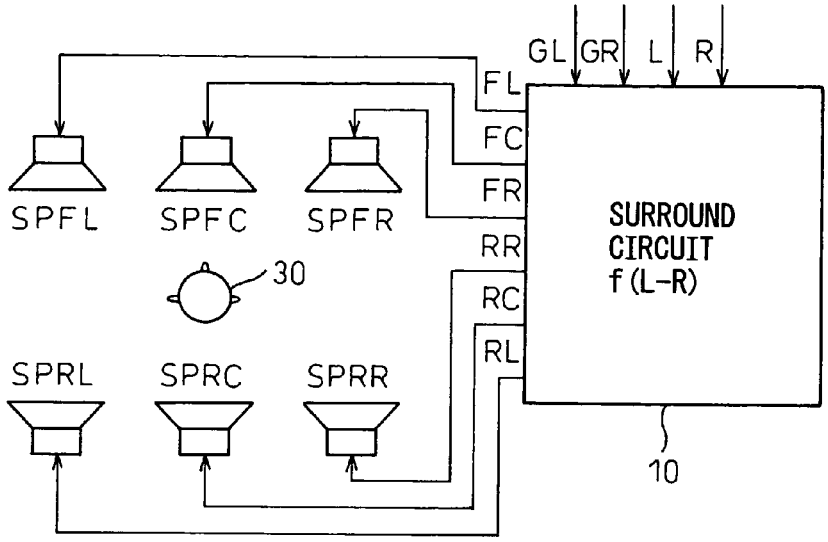
FIG. 19A shows an example of an arrangement of each speaker in a ninth aspect of the invention in which a surround circuit of the present invention is applied to a six-speaker system.

In the ninth aspect of the invention, as shown in FIG. 19A, a surround circuit of the present invention is applied to a surround system using six speakers; a front center speaker SPFC, a rear center speaker SPRC, in addition to a front left speaker SPFL, a front right speaker SPFR, a rear left speaker SPRL, and a rear right speaker SPRR.

In the ninth aspect of the invention, the following four embodiments can be made according to a signal to be mixed to the rear center speaker SPRC.

Figure 19B:
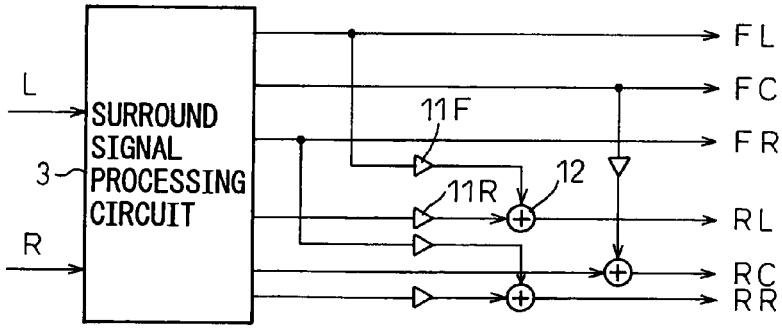
FIG. 19B is a circuit diagram showing a structure of a first embodiment in a ninth aspect of the present invention.

In the first embodiment, a part of the driving signal FC for the front center speaker SPFC is mixed to the rear center speaker SPRC, and the structure is shown in FIG. 19B. The other structures are identical to that of the first embodiment in the first aspect of the invention, therefore, the explanation will be omitted.

Figure 19C:
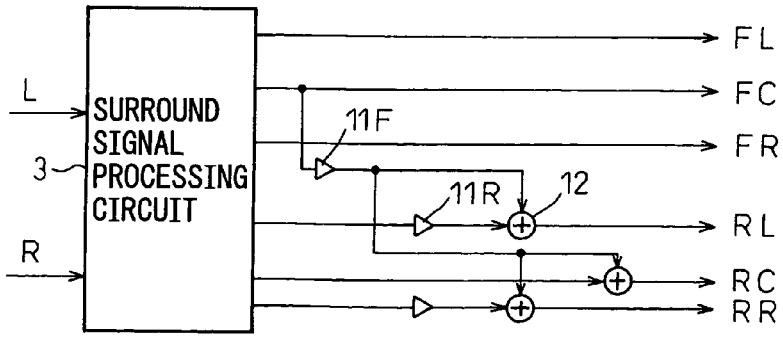
FIG. 19C is a circuit diagram showing a structure of a second embodiment in a ninth aspect of the present invention.

In the second embodiment, a part of the driving signal FC of the front center speaker SPFC is mixed to all the three rear speakers SPRL, SPRC, and SPRR, and the structure is shown in FIG. 19C.

Figure 20A:
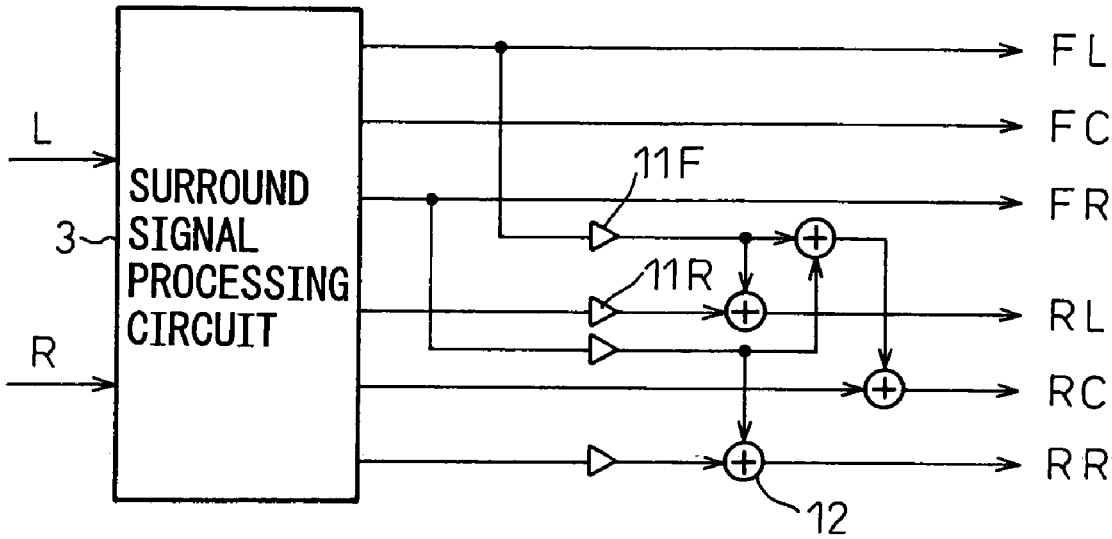
FIG. 20A is a circuit diagram showing a structure of a third embodiment in a ninth aspect of the present invention; and, FIG. 20B is a circuit diagram showing a structure of a fourth embodiment in a ninth aspect of the present invention.

In the third embodiment, the driving signal FL, FR of the front left speaker SPFL and the front right speaker SPFR are mixed and parts of which are added to the rear center speaker SPRC, and the structure is shown in FIG. 20A.

Figure 20B:
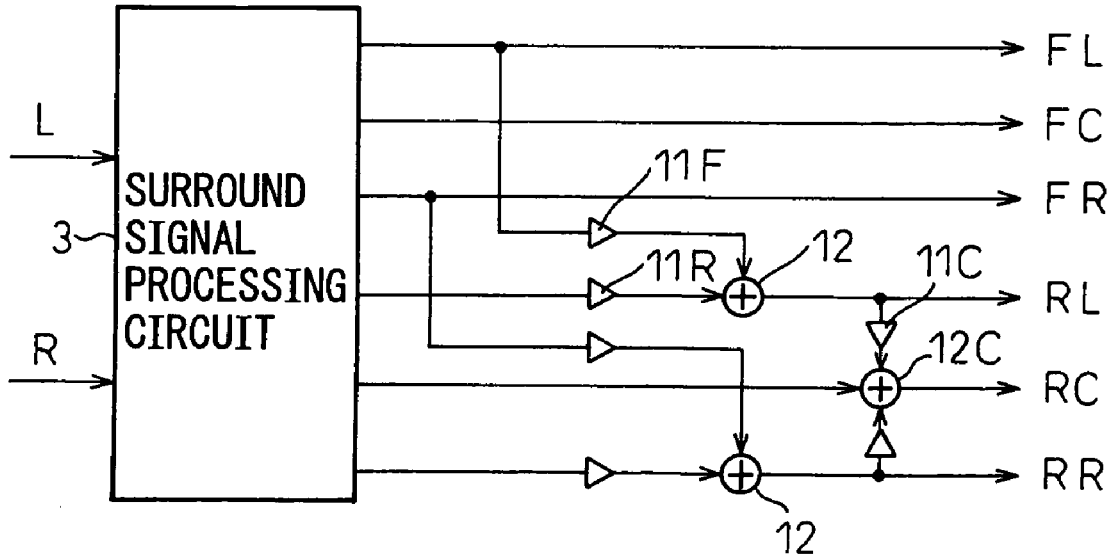

In the fourth embodiment, a part of the driving signal FL for the front left speaker SPFL mixed to the driving signal of the rear left speaker SPRL and a part of the driving signal FR of the front right speaker SPFR mixed to the driving signal of the rear right speaker SPRR are added to an adder 12C via an amplifier 11C, and the structure is shown in FIG. 20B.

Embodiments of the same structure as aforementioned (A) to (F) can be made in the ninth aspect of the invention likewise the eighth aspect of the invention.

The surround circuit of the present invention structured as above is particularly effective when the surround system provided with an FM tuner is equipped on a vehicle and the vehicle drives an area of poor radio reception.

What is claimed is:

1. An acoustic field control device comprising:

a surround signal processing circuit;

an acoustic field controller, wherein a left channel stereo signal and a right channel stereo signal generated from a two-channel stereo audio device are inputted to said surround signal processing circuit, and said surround signal processing circuit is configured to generate a plurality of surround signals based on a difference signal generated from the input left and right channel stereo signals and to output said plurality of surround signals to said acoustic field controller, and wherein said acoustic field controller is configured to generate an add signal for a surround effect correction from at least one of said left channel stereo signal and said right channel stereo signal before said left and right channel signals are inputted to said surround signal processing circuit, and to add said add signal to a surround signal outputted from said surround signal processing circuit to generate an acoustic sound for a behind of an audience to control an acoustic field; and one or more amplifiers for amplifying each signal to which said add signal is added.

2. An acoustic field control device according to claim 1, wherein said input surround signals output from said surround signal processing circuit include a surround signal for at least two right and left acoustic sounds coming from the front of the audience and at least one surround signal for an acoustic sound coming from the behind of the audience, and said acoustic field controller is further configured to add at least a part of the surround signal for said acoustic sound coming from the front of the audience to the at least one surround signal for said acoustic sound coming from the behind of the audience.

3. An acoustic field control device according to claim 2, wherein said at least one surround signal for an acoustic sound coming from the behind of the audience is a surround signal for at least two right and left acoustic sounds coming from the behind of the audience.

4. An acoustic field control device according to claim 3, wherein at least a part of said left front surround signal or at least a part of said left channel signal is added to said left rear surround signal as the add signal, and at least a part of said right front surround signal or at least a part of said right channel signal is added to said right rear surround signal as the add signal.

5. An acoustic field control device according to claim 4, wherein said surround signal includes a center front surround signal and a center rear surround signal, and at least a part of said center front surround signal is added to said center rear surround signal as the add signal.

6. An acoustic field control device according to claim 4, wherein said at least a part of the rear surround signal includes two right and left rear surround signals and a center rear surround signal, and a sum of at least parts of said right and left front surround signals is added to said center rear surround signal as the add signal.

7. An acoustic field control device according to claim 4, wherein said at least a part of the rear surround signal includes two right and left rear surround signals and a center rear surround signal, and at least a part of said left rear surround signal to which said add signal has been added and at least a part of said right rear surround signal to which said add signal has been added are added to said center rear surround signal as the add signal.

8. An acoustic field control device according to claim 3, wherein at least one of a sum of at least parts of said right and left front surround signals, and a sum of at least parts of said right and left rear channel signals is added to said right and left rear surround signals as the add signal.

9. An acoustic field control device according to claim 3, wherein at least one of a part of at least one of said right and left front surround signals, and at least a part of at least one of said right and left channel signals is added to said right and left rear surround signals as the add signal.

10. An acoustic field control device according to claim 2, wherein said surround signal includes a center front surround signal, and at least a part of said center front surround signal is added to said rear surround signal as the add signal.

11. An acoustic field control device according to claim 10, wherein said at least a part of the rear surround signal includes two right and left rear surround signals and a center rear surround signal.

12. An acoustic field control device according to claim 1, wherein said input surround signals output from said surround signal processing circuit include a surround signal for at least two right and left acoustic sounds coming from the front of the audience and at least one surround signal for an acoustic sound coming from the behind of the audience, and said acoustic field controller is further configured to add at least a part of said left channel signal or right channel signal to the at least one surround signal for said acoustic sound coming from the behind of the audience.

13. An acoustic field control device according to claim 1, further comprising a first delay part/parts in which rear surround signal to which said add signal has been added is delayed by a first predetermined time.

14. An acoustic field control device according to claim 1, further comprising a second delay part/parts in which a rear surround signal to which said add signal has been added is delayed by a second predetermined time.

15. An acoustic field control device according to claim 14, further comprising a third delay portion/portions for delaying said rear surround signal, before said add signal is added, by a third predetermined time.

16. An acoustic field control device according to claim 15, wherein said second and third predetermined times are different.

17. An acoustic field control device according to claim 1, further comprising a first compression part/parts in which a rear surround signal before addition of said add signal thereto is compressed at a first compression rate.

18. An acoustic field control device according to claim 17, wherein the compression rates of said first and second compression part/parts are substantially identical.

19. An acoustic field control device according to claim 1, further comprising a second compression part/parts in which a rear surround signal to which said add signal has been added is compressed at a second compression rate.

20. An acoustic field control device according to claim 1, further comprising a detecting part to detect a separation of said left channel signal and said right channel signal, so that the amount of said add signal to be added to a rear surround signal is controlled according to the detected separation.

21. An acoustic field control device according to claim 20, wherein the detected separation is inversely proportional to the amount of said add signal to be added to said rear surround signal.

22. An acoustic field control device according to claim 20, wherein if the detected separation is higher than a threshold value, the amount of said add signal to be added to said rear surround signal is low.

23. An acoustic field control device according to claim 1, further comprising a circuit to select sources of said input signals, wherein the amount of said add signal to be added to a rear surround signal is controlled according to a type of said audio device.

24. An acoustic field control device according to claim 23, wherein said audio device is at least one of an AM tuner, an FM tuner and a TV tuner.

25. An acoustic field control device according to claim 24, wherein a separation of a stereo signal output from said tuner is detected based on an electric field intensity received by said AM, FM, or TV tuner, and the amount of said add signal to be added to said rear surround signal is controlled according to a degree of detected separation.

26. An acoustic field control device according to claim 1, wherein said acoustic field control device is provided in a vehicle.

27. An acoustic equipment comprising:

an audio reproducing device to output a two-channel stereo signal; and an acoustic field control device comprising:

a surround signal processing circuit;

an acoustic field controller, wherein said two-channel stereo signal includes a left channel stereo signal and a right channel stereo signal inputted to said surround signal processing circuit, wherein said surround signal processing circuit is configured to generate a plurality of surround signals based on a difference signal generated from the right and left channel stereo signals and output said plurality of surround signals to said acoustic field controller, and wherein said acoustic field controller is configured to generate an add signal for a surround effect correction based on one or both of said left channel stereo signal or said right channel stereo signal before said left and right channel stereo signals are inputted to said surround signal processing circuit, and to add said add signal to a surround signal outputted from said surround signal processing circuit to generate an acoustic sound for a behind of an audience to control an acoustic field; and one or more amplifiers for amplifying each signal to which said add signal is added.

* * * * *